US008992281B2

(12) United States Patent
Lui et al.

(10) Patent No.: US 8,992,281 B2
(45) Date of Patent: Mar. 31, 2015

(54) TOY FIGURE DISPLAY STAND

(75) Inventors: Kenny Yuk Wa Lui, Torrance, CA (US); Wai (Ricky Choi) Kei Choi, Wong Chuk Hang (HK); Qiwen (Chris Fong) Fang, Hu Bei (CN); Ted Kwok Leung Chiu, Hong Kong (HK)

(73) Assignee: Mattel, Inc., El Segundo, CA (US)

( * ) Notice: Subject to any disclaimer, the term of this patent is extended or adjusted under 35 U.S.C. 154(b) by 224 days.

(21) Appl. No.: 13/446,443

(22) Filed: Apr. 13, 2012

(65) Prior Publication Data

US 2012/0261282 A1 Oct. 18, 2012

Related U.S. Application Data

(60) Provisional application No. 61/474,965, filed on Apr. 13, 2011.

(51) Int. Cl.
*A63H 3/00* (2006.01)
*A63H 3/50* (2006.01)

(52) U.S. Cl.
CPC ..... *A63H 3/50* (2013.01)
USPC ..... 446/72; 446/75; 446/268; 206/549

(58) Field of Classification Search
CPC ..... A63H 17/262; A63H 19/16
USPC ..... 206/216, 549; 446/72, 74, 75, 267
See application file for complete search history.

(56) References Cited

U.S. PATENT DOCUMENTS

| | | | |
|---|---|---|---|
| 1,777,944 | A | 10/1930 | Trovato |
| 2,144,551 | A | 1/1939 | Skolnick |
| 4,047,633 | A | 9/1977 | Trombly |
| 4,353,327 | A | 10/1982 | Shroyer |
| 4,869,005 | A | 9/1989 | Valentino |
| 4,928,412 | A | 5/1990 | Nishiyama |
| 4,939,859 | A | 7/1990 | Bradt |
| 4,941,590 | A | 7/1990 | Pantaleo et al. |
| 5,104,699 | A | 4/1992 | Pantaleo et al. |
| 5,150,815 | A | 9/1992 | Saklad |
| 5,165,781 | A | 11/1992 | Orak |
| 5,211,469 | A | 5/1993 | Matthias et al. |
| 5,256,457 | A | 10/1993 | Pantaleo et al. |

(Continued)

FOREIGN PATENT DOCUMENTS

| | | | |
|---|---|---|---|
| JP | 3119126 | U | 1/2006 |
| JP | 2009217118 | A | 9/2009 |
| WO | 99/04380 | A1 | 1/1999 |

OTHER PUBLICATIONS

International Search Report for PCT/US2012/033518 dated Nov. 1, 2012, 3 pages.

*Primary Examiner* — Anthony Stashick
*Assistant Examiner* — Raven Collins
(74) *Attorney, Agent, or Firm* — Edell, Shapiro & Finnan LLC

(57) ABSTRACT

A toy figure display stand displays a toy figure behind a transparent fluid-retaining wall, thus simulating immersion of the toy figure within the transparent fluid. The simulated immersion provides an additional level of engagement between the toy figure and a child or collector. The wall may include an interior transparent shell portion and an exterior transparent shell portion. The interior transparent shell portion and the exterior transparent shell portion may together define a cavity. A fluid may be received within the cavity.

20 Claims, 22 Drawing Sheets

(56) References Cited

U.S. PATENT DOCUMENTS

| | | | | | |
|---|---|---|---|---|---|
| 5,261,848 | A | * | 11/1993 | Kaplan et al. | 446/74 |
| 5,272,604 | A | * | 12/1993 | Lin | 362/96 |
| 5,272,681 | A | | 12/1993 | Lee | |
| 5,291,674 | A | * | 3/1994 | Torrence | 40/410 |
| 5,349,771 | A | | 9/1994 | Burnett | |
| 5,416,994 | A | | 5/1995 | McLaughlin | |
| 5,442,869 | A | | 8/1995 | McDarren et al. | |
| 5,465,909 | A | | 11/1995 | Roth | |
| D375,411 | S | | 11/1996 | Hawkins | |
| 5,666,750 | A | | 9/1997 | Segan et al. | |
| 5,791,078 | A | | 8/1998 | Maranto et al. | |
| 5,819,452 | A | | 10/1998 | Hakkert | |
| 5,985,379 | A | | 11/1999 | Longsdorf et al. | |
| 6,027,774 | A | | 2/2000 | Fine et al. | |
| D423,924 | S | | 5/2000 | Laracy | |
| 6,119,382 | A | | 9/2000 | Hakkert | |
| 6,187,394 | B1 | | 2/2001 | Johnson et al. | |
| 6,193,578 | B1 | | 2/2001 | Weber | |
| 6,205,689 | B1 | * | 3/2001 | TenBrink | 40/410 |
| 6,263,600 | B1 | | 7/2001 | Brink | |
| 6,438,878 | B1 | | 8/2002 | Fine et al. | |
| 6,464,078 | B1 | | 10/2002 | Grossnickle | |
| 6,484,425 | B1 | | 11/2002 | Hirsch | |
| 6,550,168 | B1 | * | 4/2003 | Campos | 40/406 |
| 6,574,897 | B1 | | 6/2003 | Timmer | |
| 6,663,464 | B2 | | 12/2003 | Payne et al. | |
| 6,722,064 | B2 | | 4/2004 | Knapp et al. | |
| 6,865,833 | B2 | | 3/2005 | Kliakhandler et al. | |
| 6,880,274 | B2 | | 4/2005 | Liu | |
| D512,310 | S | | 12/2005 | Hite | |
| 7,322,134 | B2 | | 1/2008 | Cheek et al. | |
| 7,430,823 | B1 | | 10/2008 | Chung | |
| 7,527,542 | B2 | | 5/2009 | Collins et al. | |
| 2002/0090879 | A1 | | 7/2002 | Galomb | |
| 2008/0308085 | A1 | * | 12/2008 | Polk, III | 124/1 |
| 2009/0275259 | A1 | | 11/2009 | Yu | |

* cited by examiner

TOY FIGURE DISPLAY STAND

CROSS-REFERENCE TO RELATED APPLICATION

This application claims priority to and is based on U.S. Patent Application No. 61/474,965, filed Apr. 13, 2011, entitled "Toy Figure Display Stand," the entire disclosure of which is incorporated by reference herein in its entirety.

FIELD OF THE INVENTION

The disclosure relates generally to a toy figure display stand. More specifically, the toy figure display stand may display a toy figure behind a transparent fluid-holding front wall panel.

BACKGROUND

An increasing number of water-themed toy figures have appeared in the marketplace. These figures range from mermaid dolls to underwater action figures. Children and figure collectors gain an emotional attachment to these figures. Doll stands provide the child and figure collector with a means to display and pose the toy figure.

U.S. Pat. No. 5,261,848 to Kaplan et al ("Kaplan") discloses a toy with liquid-filled shell. The toy includes a base, a character figure on the base, and a dome-shaped housing on the base over the character figure. Inner and outer transparent shell portions cooperate to define an enclosed cavity therebetween, and a transparent liquid with sparkling particles suspended therein is received within the cavity. While the Kaplan housing creates an appearance that the figure is received in the liquid, it requires the extra effort of lifting the entire dome-shaped housing to place the toy inside or take the toy out of the housing. It also requires a large amount of the liquid in the toy and near the figure.

Kaplan also discloses a second embodiment, a toy including an opaque housing having a window therein. The window includes transparent inner and outer shell portions, which cooperate to define a cavity therein. A transparent liquid is received in the cavity. While this toy creates the appearance that a figure inside the housing compartment is received in the liquid, the housing configuration and small window do not display any figure presentably.

U.S. Pat. No. 6,193,578 B1 to Weber ("Weber") discloses a bubbling brain novelty. The novelty includes a transparent vessel containing a fluid and a life-like full scale human brain inserted into the fluid. The vessel is open on its top and sealed on its bottom, and is mounted on a base portion of the device. Air bubbles are produced from an air pump, and the vessel is lit from underneath by a lamp. While this item is certainly a novelty, the feature on display, namely the brain, is actually submersed and not suitable for features that are intended to stay relatively dry.

SUMMARY

A toy figure display stand may display a toy figure behind a transparent fluid-holding wall. The wall may include an inner transparent shell portion and an outer transparent shell portion. The inner transparent shell portion and the outer transparent shell portion may together define a cavity. A fluid may be received within the cavity.

Other systems, methods, features and advantages will be, or will become, apparent to one with skill in the art upon examination of the following figures and detailed description.

All such additional systems, methods, features and advantages are included within this description, are within the scope of the claimed subject matter.

BRIEF DESCRIPTION OF THE DRAWINGS

The toy figure display stand may be better understood with reference to the following drawings and description. The elements in the figures are not necessarily to scale, emphasis instead being placed upon illustrating the principles of the toy figure display stand. In the figures, like-referenced numerals designate corresponding parts throughout the different views.

DETAILED DESCRIPTION

A toy figure display stand includes a transparent fluid-holding front wall panel. The front wall panel may include an inner transparent shell portion and an outer transparent shell portion which together define a cavity. A back panel may be attached to the front wall panel, the back panel operable to open and provide access to the toy figure display chamber. The front wall panel may be tapered to provide a draft angle for improved one-piece injection-molded manufacturing and increased durability.

Figure 1:
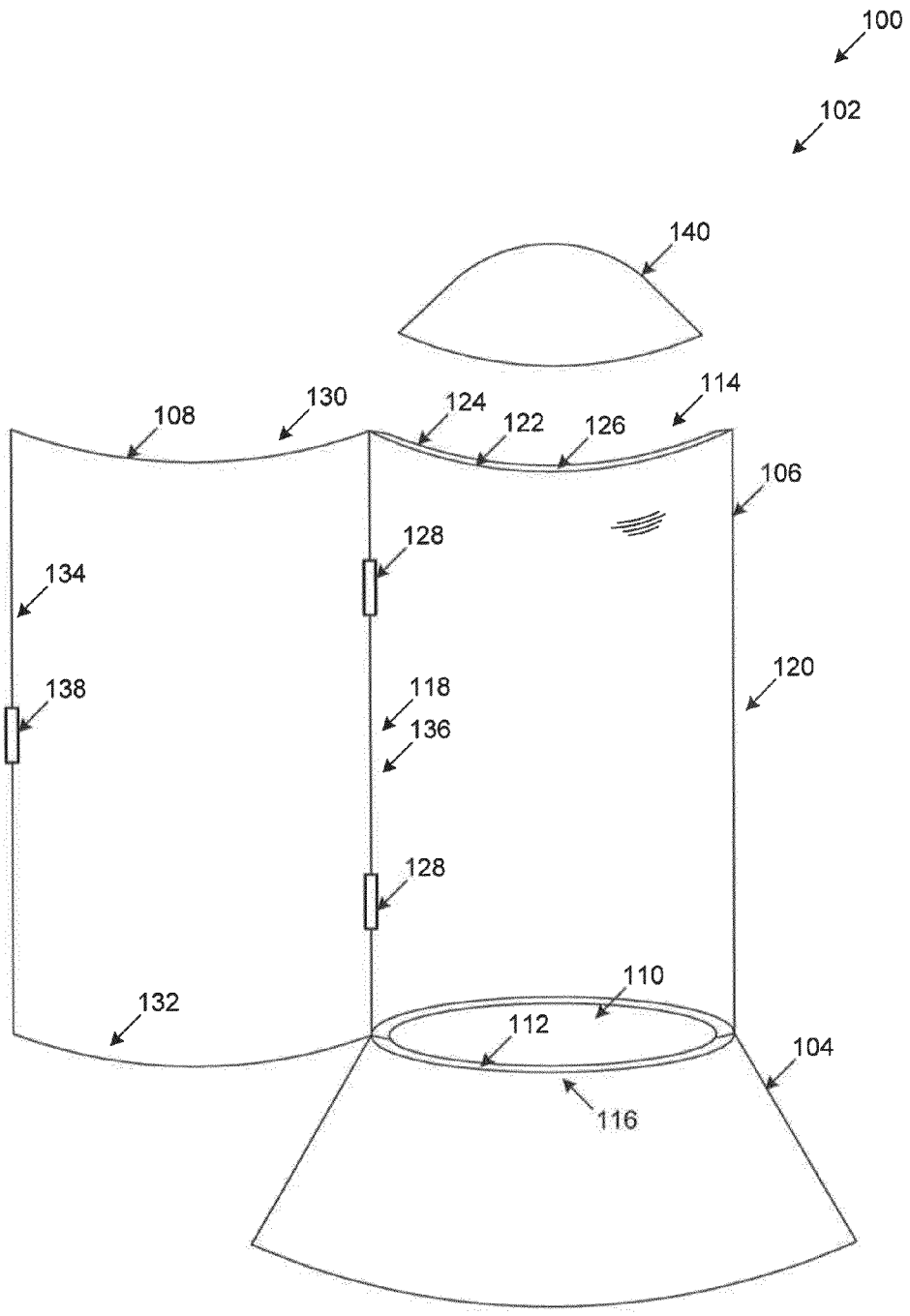
FIG. 1 is a drawing of a first embodiment of a toy figure display stand.

FIG. 1 is a drawing 100 of a first embodiment of a toy figure display stand 102 according to the present invention. The toy figure display stand 102 includes a base 104, a transparent wall panel 106, and a back panel 108. The base 104 includes an upper surface 110 upon which the transparent wall panel 106 may be mounted or attached. The transparent wall panel 106 may be friction-fitted, compression-fitted, thermally sealed, adhered, or otherwise attached to the upper surface 110 of the base 104 or to a groove 112 or mounting aid in the upper surface 110. A toy figure may be posed to stand on top of the upper surface 110 of the base 104. Such a posed figure may be displayed and viewed from multiple viewing angles through the transparent wall panel 106. In an alternative embodiment, the toy figure may be mounted to the upper surface 110 to aid in posing the figure and to provide a more consistent display. The base 104 may serve as a pedestal for a toy figure while housing various electronics and components used to enhance the display of the toy figure.

The transparent wall panel 106 includes an upper edge 114, a lower edge 116, a left edge 118, and a right edge 120. The transparent wall panel 106 further includes an exterior shell portion 122 and an interior shell portion 124. The exterior shell portion 122 and the interior shell portion 124 may be attached to each other along one or more of their edges to form a cavity 126 between the two portions. The two portions may be attached along their edges using physical means, such as one or more screws, chemical means, such as an epoxy, resin, glue, or other adhesive, or thermal means, such as melting the edges together. In a preferred embodiment, the shell portions are formed from a single piece of material. For example, the shell portions may be formed from a single injection-molded piece of plastic or acrylic. In yet another preferred embodiment, the transparent wall panel 106 includes at least one opening along one of its edges that provides access for fluid exchange with the cavity 126 between the two shell portions.

The back panel 108 includes an upper side 130, a lower side 132, a left side 134, and a right side 136. The back panel 108 is movably attached to the toy figure display stand 102. In the illustrated embodiment, the back panel 108 is attached to the transparent wall panel 106 by one or more hinges 128. In alternative embodiments, the back panel 108 is hingedly attached to the base 104 or removably attached to the toy figure display stand 102.

The transparent wall panel 106 and the back panel 108 each includes a curvature such that the right side 136 of the back panel 108 abuts the left edge 118 of the transparent wall panel 106 and the left side 134 of the back panel 108 abuts the right edge 120 of the transparent wall panel 106. In this configuration, the back panel 108 may be considered to be in a closed position. In the closed position, the bottom edge 116 of the transparent wall panel 106 and the bottom side 132 of the back panel 108 enclose the upper surface 110 of the base 104, and the transparent wall panel 106, the back panel 108, and the upper surface 110 of the base 104 form three sides of a display chamber for a toy figure. The interior shell portion 124 and the exterior shell portion 126 of the transparent wall panel 106 and a fluid within the cavity 126 may all be substantially transparent. The transparency may create an overall effect that the display chamber for the toy figure is completely or substantially filled with the fluid, when the fluid is actually contained entirely within the cavity 126.

The back panel 108 further includes a latch 138. The latch 138 is preferably located along the edge of the back panel 108 opposite the hinges 128. The latch 138 may interface with the transparent wall panel 106 to hold the back panel 108 in the closed position.

In the illustrated embodiment, the back panel 108 abuts the transparent wall panel 106 along only one edge. This configuration may be considered as an open position. The open position may provide physical access to the display chamber, for example, to place a toy figure inside or take a toy figure out of the toy figure display stand 102.

The toy figure display stand 102 further includes an enclosure lid 140. The enclosure lid 140 may be pivotably, hingedly or removably attached to the top of the toy figure display stand 102. In some embodiments, the enclosure lid 140 may be fixedly attached to the upper edge 114 of the transparent wall panel 106. The enclosure lid 140 may keep fluid within the cavity 126 or provide a fourth surface defining a toy display chamber.

Figure 2:
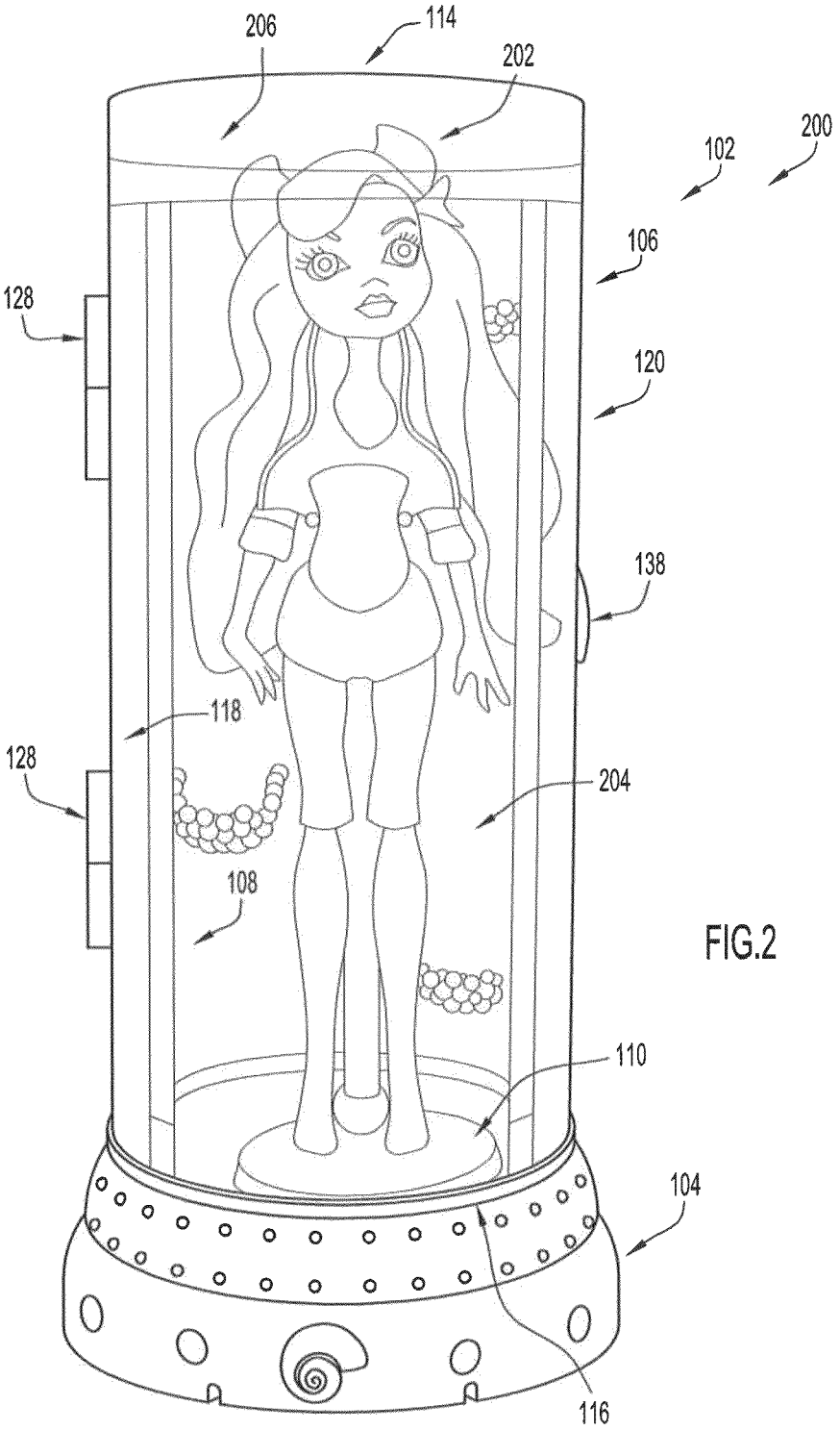
FIG. 2 is a front photographic view of a second embodiment of a toy figure display stand.

FIG. 2 is a front photographic view 200 of a second embodiment of a toy figure display stand 102 according to the present invention. The toy figure display stand 102 includes a base 104, a transparent wall panel 106, and a back panel 108. The base 104 includes an upper surface 110 upon which the transparent wall panel 106 may be mounted or attached. A toy FIG. 202 is posed and standing on top of the upper surface 110 of the base 104. The transparent wall panel 106 includes an upper edge 114, a lower edge 116, a left edge 118, and a right edge 120. In this embodiment, the back panel 108 is attached to the transparent wall panel 106 by two hinges 128.

The transparent wall panel 106 and the back panel 108 each includes a curvature such that the back panel 108 abuts the left edge 118 of the transparent wall panel 106 and the right edge 120 of the transparent wall panel 106. In this configuration, the back panel 108 may be considered to be in a closed position. In the closed position, the transparent wall panel 106, the back panel 108, and the upper surface 110 of the base 104 form three sides of a display chamber 204 for the toy FIG. 202. The back panel 108 further includes a latch 138. The latch 138 interfaces with the transparent wall panel 106 to hold the back panel 108 in the closed position. In this embodiment, physical access to the display chamber 204 to place the toy FIG. 202 inside or take the toy FIG. 202 out of the toy figure display stand 102 is available from an enclosure lid opening 206 at the top of the toy figure display stand 102. The enclosure lid opening 206 may be defined by the upper edge 114 of the transparent wall panel 106 and an upper side of the back panel 108. Increased access to the display chamber 204 may be available by opening the back panel 108.

Figure 3:
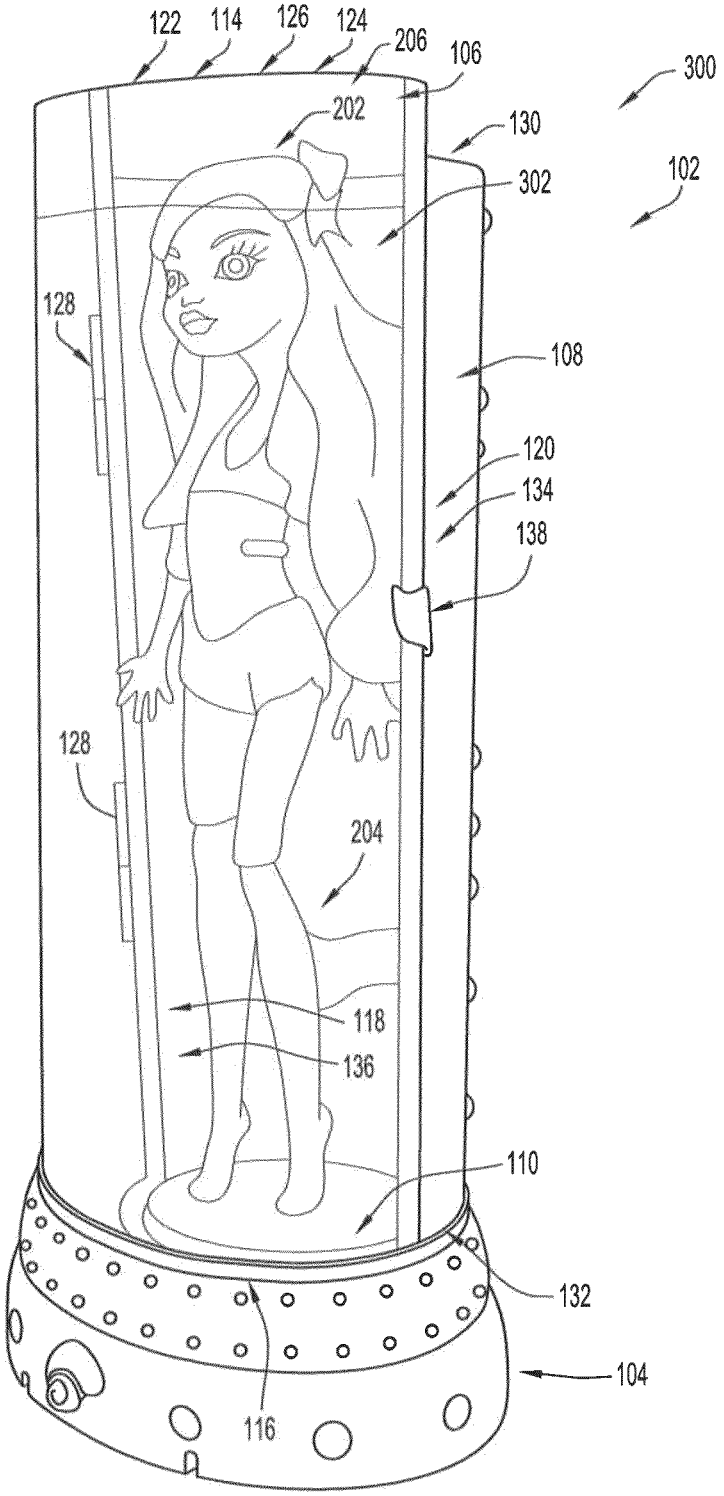
FIG. 3 is a front-right perspective photographic view of the second embodiment of a toy figure display stand.

FIG. 3 is a front-right perspective photographic view 300 of the second embodiment of a toy figure display stand 102. The transparent wall panel 106 includes an exterior shell portion 122 and an interior shell portion 124. The exterior shell portion 122 and the interior shell portion 124 are attached to each other along the left edge 118, the right edge 120, and the bottom edge 116 of the transparent wall panel 106 to form a cavity 126 between the two portions. A fluid 302 is retained within a portion of the cavity 126. In this embodiment, the fluid 302 is water. The back panel 108 includes an upper side 130, a lower side 132, a left side 134, and a right side 136. The left side 134 of the back panel 108 abuts the right edge 120 of the transparent wall panel 106.

Figure 4:
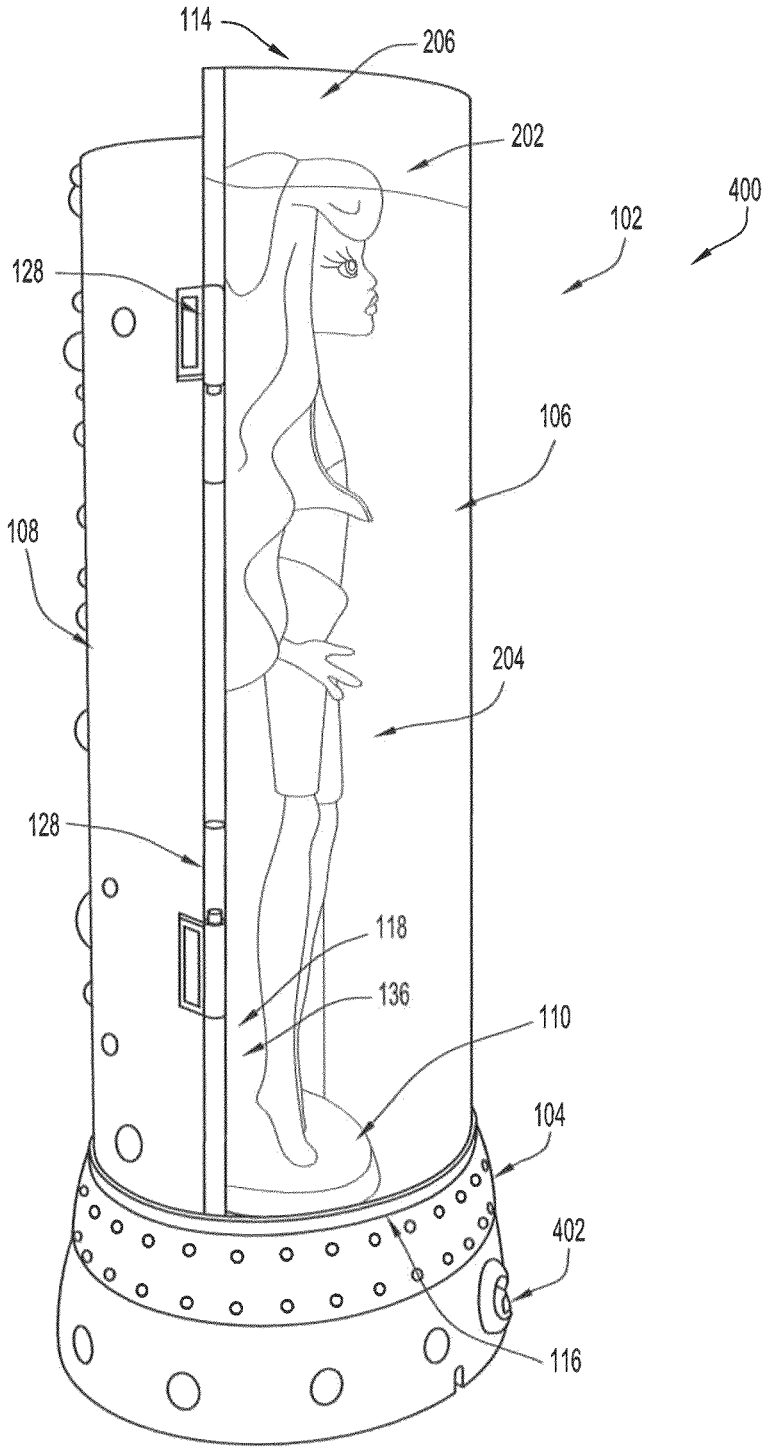
FIG. 4 is a front-left perspective photographic view of the second embodiment of a toy figure display stand.

FIG. 4 is a front-left perspective photographic view 400 of the second embodiment of a toy figure display stand 102. The right side 136 of the back panel 108 abuts the left edge 118 of the transparent wall panel 106. The toy figure display stand 102 further includes an actuator 402. The actuator 402 is movably embedded on the base 104. The actuator 402 may be interacted with to activate one or more electronics and/or components in the toy figure display stand 102 used to enhance the display of the toy FIG. 202. In this embodiment, the actuator 402 is a push button or contact switch in the shape of a sea shell.

Figure 5:
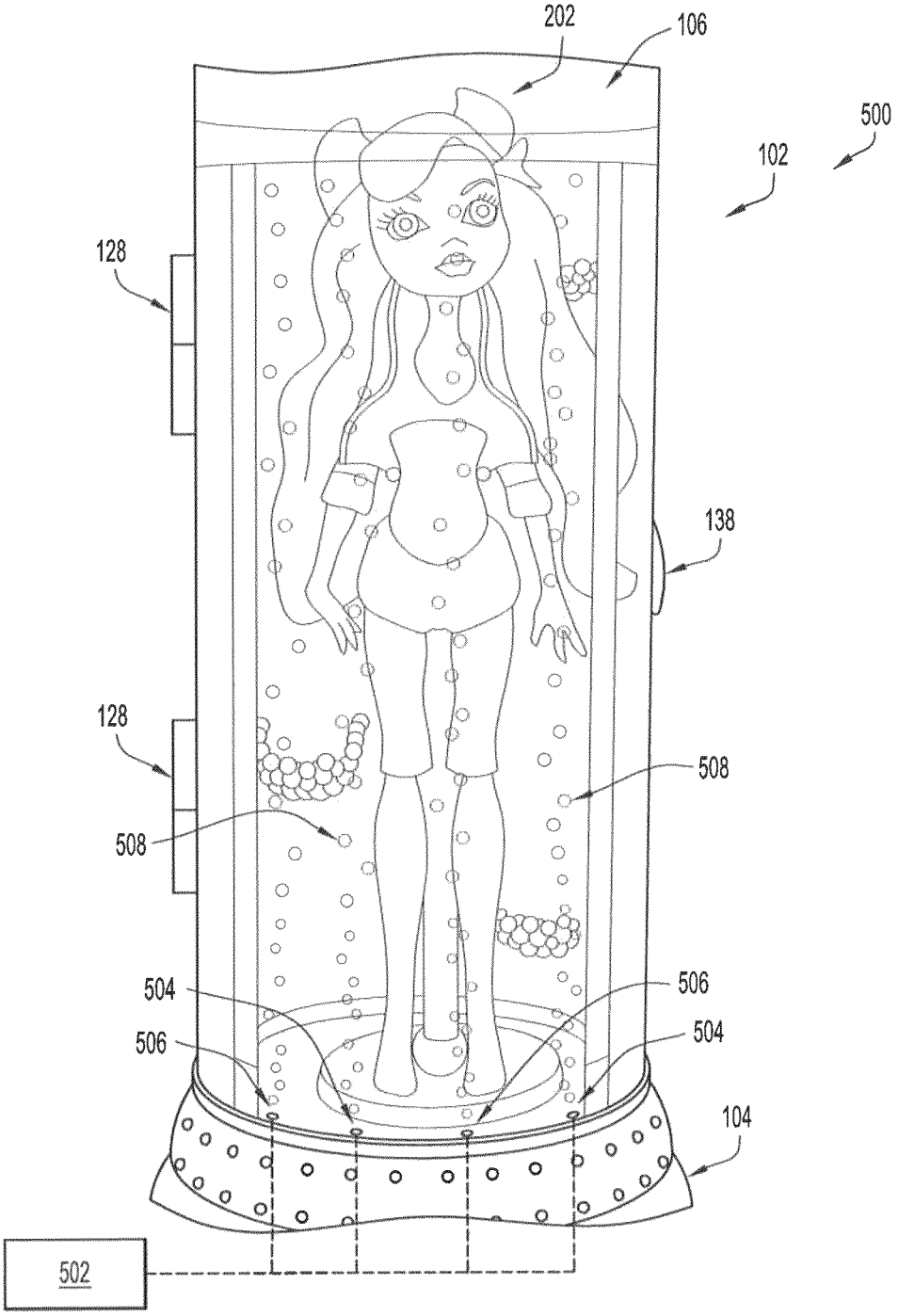
FIG. 5 is a front photographic view of the second embodiment of a toy figure display stand in an activated state.

FIG. 5 is a front photographic view 500 of the second embodiment of a toy figure display stand 102 in an activated state. An activated state may be achieved when an actuator 302 is properly actuated. For example, a button may be pushed. The actuator 302 may signal one or more electronics and/or components 502. The electronics 502 may include a microcontroller, one or more circuits, and/or one or more power sources, such as a motor or a battery, among other things. The electronics 502 may be housed within the base 104 to provide compactness. Alternatively, the electronics 502 may be housed separately from the base 104 to provide improved accessibility to the components.

In the illustrated activated state, the electronics 502 include a power source providing power to light sources 504, 506. The light sources 504, 506 include light-emitting diodes (LEDs) of a first color 504 and a second color 506. The light sources 504, 506 may illuminate various portions of the toy figure display stand 102 and/or the toy FIG. 202. The light sources 504, 506 may provide illumination external to the toy figure display stand 102 and may add to the usefulness of the toy figure display stand 102, for example, as a night light or room decoration. In some embodiments, the light sources 504, 506 may shine into the edge of transparent wall panel 106 to provide an intensity lighting effect. The electronics 502 may further include an air compressor creating air bubbles 508 within a fluid inside the cavity 126.

Figure 6:
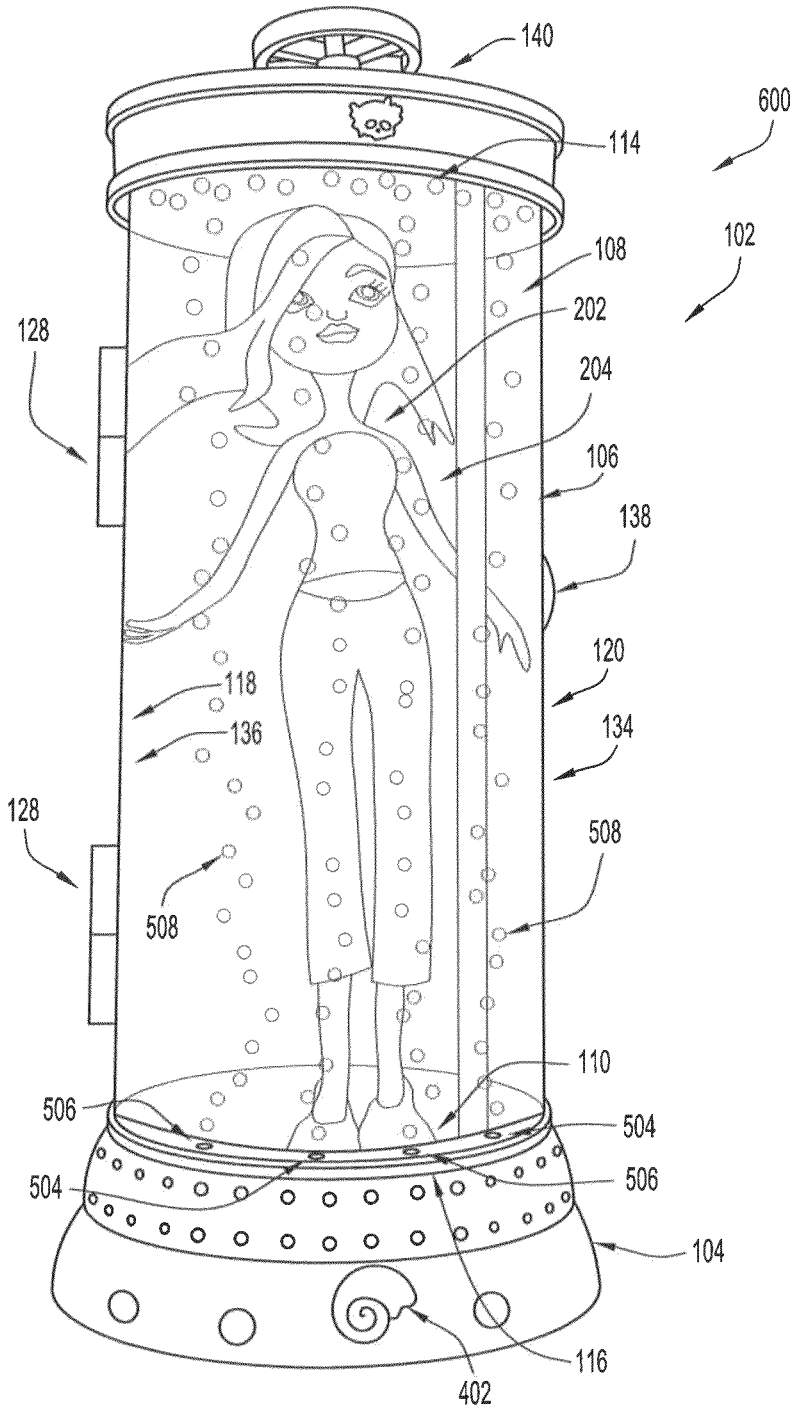
FIG. 6 is a front photographic view of a third embodiment of a toy figure display stand in a closed position.

FIG. 6 is a front photographic view 600 of a third embodiment of a toy figure display stand 102 in a closed position according to the present invention. The toy figure display stand 102 includes a base 104, a transparent wall panel 106, a back panel 108, and an enclosure lid 140. The base 104 includes an upper surface 110. A toy FIG. 202 is posed and standing on top of the upper surface 110. The transparent wall panel 106 includes an upper edge 114, a lower edge 116, a left edge 118, and a right edge 120. In this embodiment, the back panel 108 is attached to the transparent wall panel 106 by two hinges 128. The transparent wall panel 106, the back panel 108, the upper surface 110 of the base 104 and the enclosure lid 140 form the sides of a display chamber 204 for the toy FIG. 202. The back panel 108 further includes a latch 138 to hold the back panel 108 in the closed position. The toy figure display stand 102 is shown in an activated state. The light sources 504, 506 illuminate various portions of the toy figure display stand 102 and/or the toy FIG. 202. An air compressor (not shown) inside the base 104 creates air bubbles 508 within a fluid inside the cavity 126.

Figure 7:
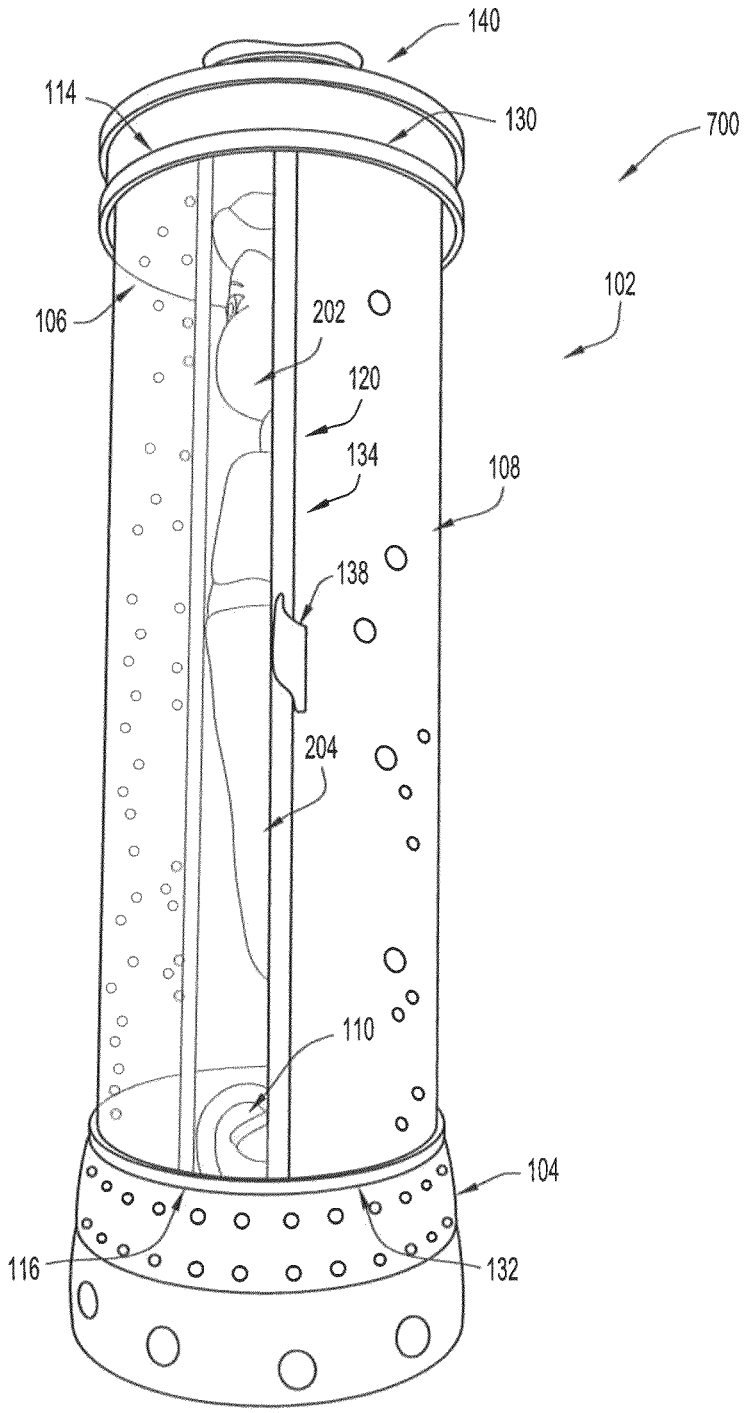
FIG. 7 is a right photographic view of the third embodiment of a toy figure display stand in a closed position.

FIG. 7 is a right photographic view 700 of the third embodiment of a toy figure display stand 102 in a closed position. The back panel 108 includes an upper side 130, a lower side 132, a left side 134, and a right side 136. The left side 134 of the back panel 108 abuts the right edge 120 of the transparent wall panel 106.

Figure 8:
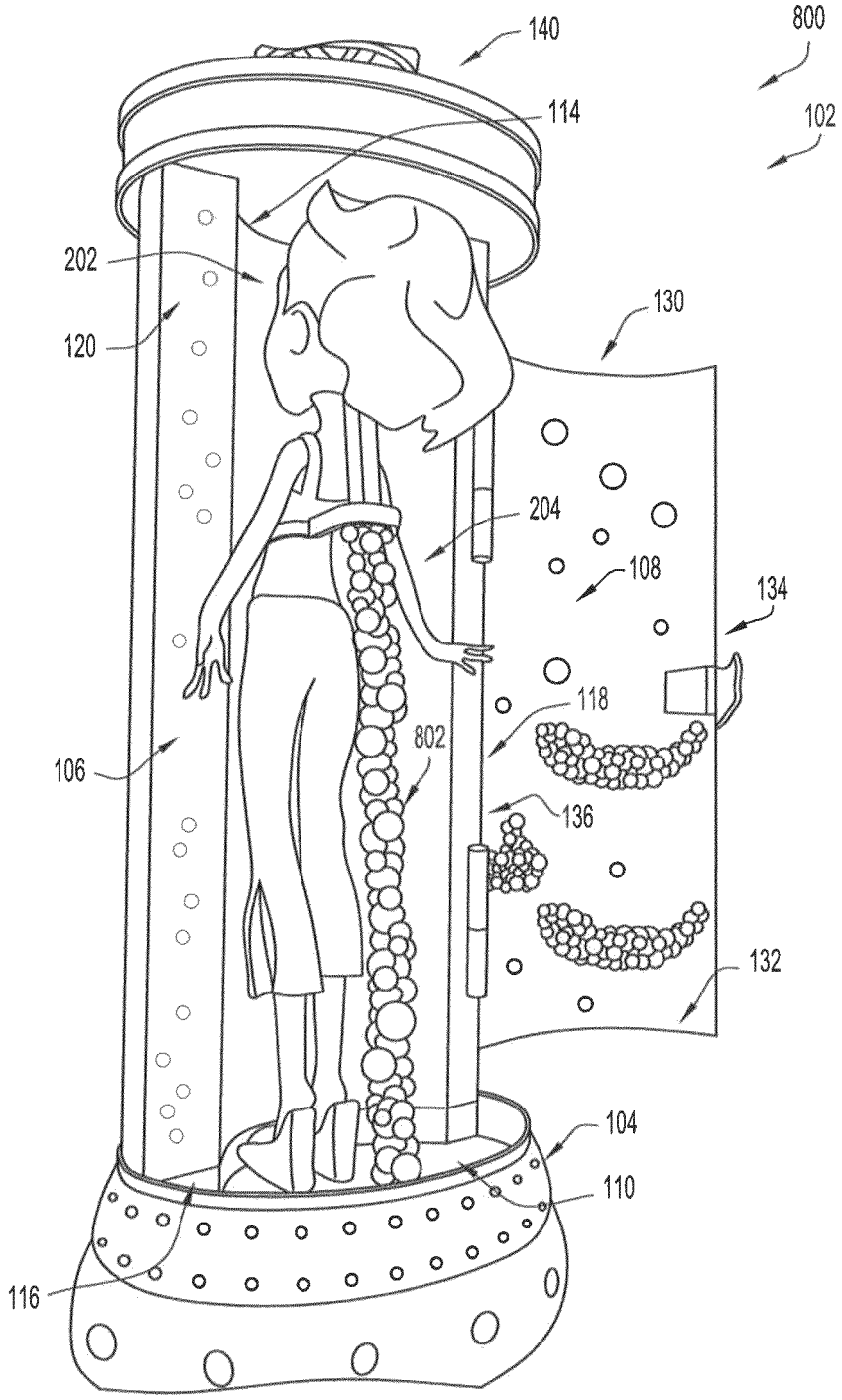
FIG. 8 is a back-right perspective photographic view of the third embodiment of a toy figure display stand in an open position.

FIG. 8 is a back-right perspective photographic view 800 of the third embodiment of a toy figure display stand 102 in an open position. The toy figure display stand 102 includes a base 104, a transparent wall panel 106, a back panel 108, and an enclosure lid 140. The enclosure lid 140 is fixedly attached to the upper edge 114 of the transparent wall panel 106. The base 104 includes an upper surface 110. A toy FIG. 202 is posed and standing on top of the upper surface 110. In this configuration, the transparent wall panel 106, the upper surface 110 of the base 104, and the enclosure lid 140 form the sides of a display chamber 204 for the toy FIG. 202. The display chamber 204 further includes a doll stand 802. The doll stand 802 is attached to the upper surface 110 of the base 104. The doll stand 802 clips onto a portion of the toy FIG. 202 and aids in the presentation and display of the toy FIG. 202 by keeping the toy FIG. 202 in an upright position. In alternative embodiments, the doll stand 802 may be integrated with or attached to the transparent wall panel 106 and/or the back panel 108.

Figure 8A:
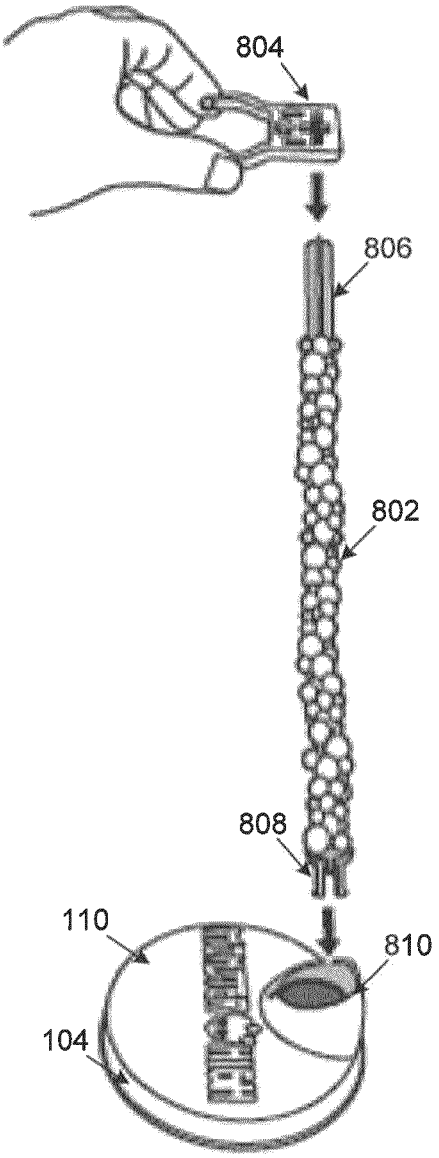
FIG. 8A is a side perspective view of some components of a toy figure display stand in an exploded arrangement.
Figure 8B:
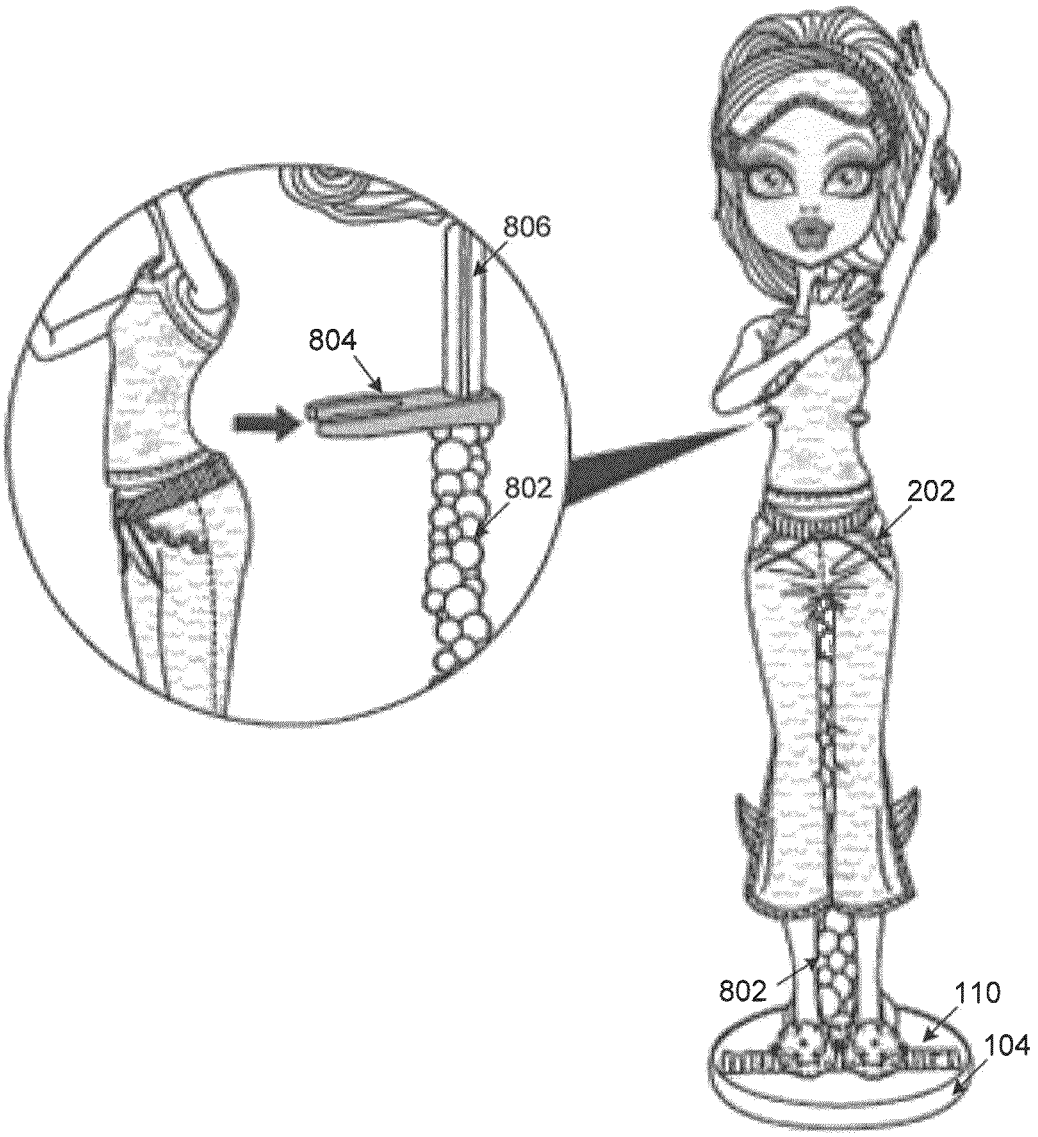
FIG. 8B includes a front view and a side view of a toy figure and the display stand of FIG. 8A.

FIGS. 8A-B are computer drawings of the doll stand 802 of the third embodiment. FIG. 8A shows doll stand 802 in an exploded view in order to further demonstrate how stand 802 may be attached to both the upper surface 110 of base 104 and doll 202. As seen in FIG. 8A, stand 802 includes a shaped portion 806, a doll clip 804, and a protrusion 808. Clip 804 slidably engages at least portion 806 of stand 802, thus allowing stand 802 to clip onto portions of toy FIG. 202 disposed at different heights, such as the waist or hips. Protrusion 808 extends from the bottom of the stand 802 and may be integrally formed with stand 802 or coupled thereto in any desirable manner. Protrusion 808 may be configured to engage the top surface 110 of base 104.

As seen in FIG. 8B, clip 804 may be slid over portion 806 on doll stand 802 such that it may engage or clip onto a portion of toy 202. Stand 802 may include a textured or wider portion beneath section 806 configured to ensure doll 202 is held in an upright position. Either before or after engaging doll 202, stand 206 may be attached to the top surface 110 of base 104 by inserting protrusion 808 into cylindrical boss 810. Protrusion 808 may engage cylindrical boss 810 (as shown in FIG. 8A) in any desirable manner, such as a snap fit, such that stand 802 may be extend from base 104 in a substantially vertical manner.

Figure 9:
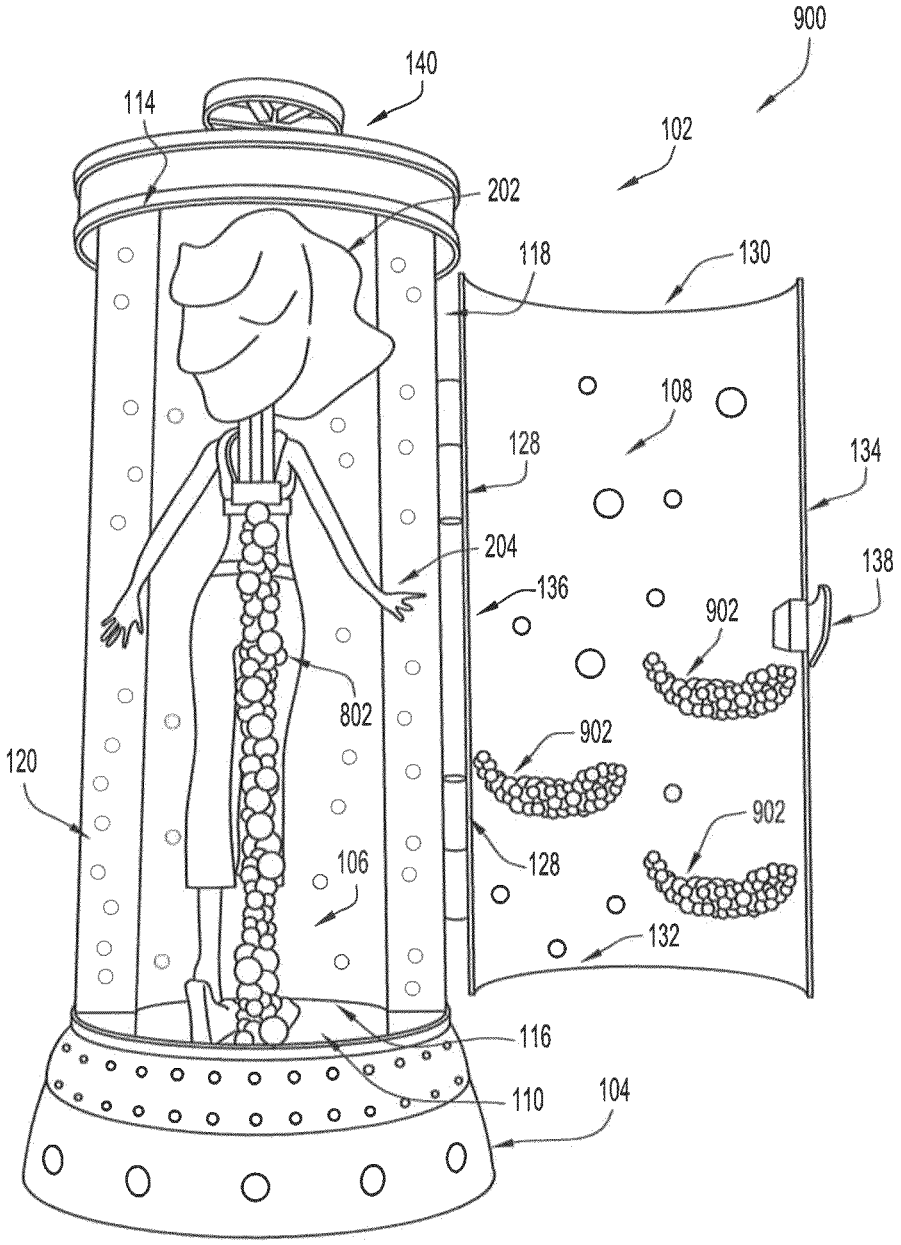
FIG. 9 is a back photographic view of the third embodiment of a toy figure display stand in an open position.

FIG. 9 is a back photographic view 900 of the third embodiment of a toy figure display stand 102 in an open position. The back panel 108 is attached to the transparent wall panel 106 by two hinges 128. Physical access to the display chamber 204 to place the toy FIG. 202 inside or take the toy FIG. 202 out of the toy figure display stand 102 is available by opening the back panel 108. The back panel 108 further includes one or more accessory shelves 902. Each accessory shelf 902 may be integrated with or attached to the back panel 108. In this embodiment, the accessory shelves 902 were formed together with the back panel 108 as part of the same mold. Each accessory shelf 902 may hold one or more accessories associated with the toy FIG. 202, such as a doll's comb or an action figure's weapon. An accessory shelf 902 may provide space for an accompanying pet, animal, sidekick, or familiar. The accessory shelves 902 may further be positioned on the back panel 104 to enhance the display of the toy FIG. 202. In this embodiment, the accessory shelves 902 are positioned low and towards the sides of the display chamber 204, such that accessories positioned on the accessory shelves 902 are not blocked from view by the toy FIG. 202, when the toy figure display stand 102 is in a closed position.

Figure 10:
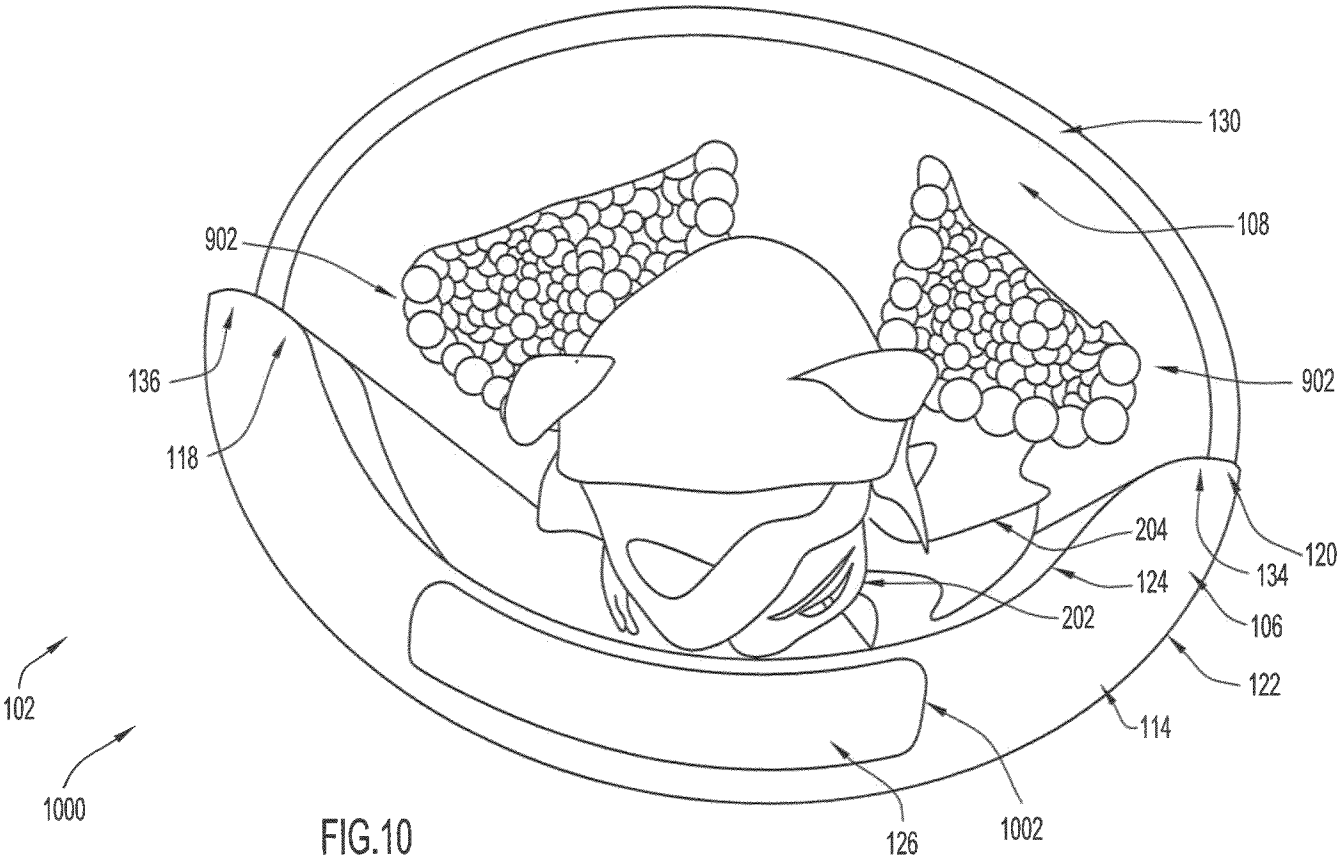
FIG. 10 is a top photographic view of the second embodiment of a toy figure display stand in a closed position with a toy figure.

FIG. 10 is a top photographic view 1000 of the second embodiment of a toy figure display stand 102 in a closed position with a toy FIG. 202. The transparent wall panel 106 and the back panel 108 each includes a curvature such that the right side 136 of the back panel 108 abuts the left edge 118 of the transparent wall panel 106 and the left side 134 of the back panel 108 abuts the right edge 120 of the transparent wall panel 106. The display chamber 204 is defined by the transparent wall panel 106, the back panel 108, and the upper surface 110 of the base 104. The toy FIG. 202 is posed and standing within the display chamber 204.

The transparent wall panel 106 further includes an exterior shell portion 122 and an interior shell portion 124. In this embodiment, the transparent wall panel 106 is formed from a single piece of injection-molded acrylic. The exterior shell portion 122 and the interior shell portion 124 form a cavity 126 between the two portions. The transparent wall panel 106 includes a fluid exchange opening 1002 along the upper edge 114 of the transparent wall panel 106 that provides access for fluid exchange with the cavity 126.

Figure 11:
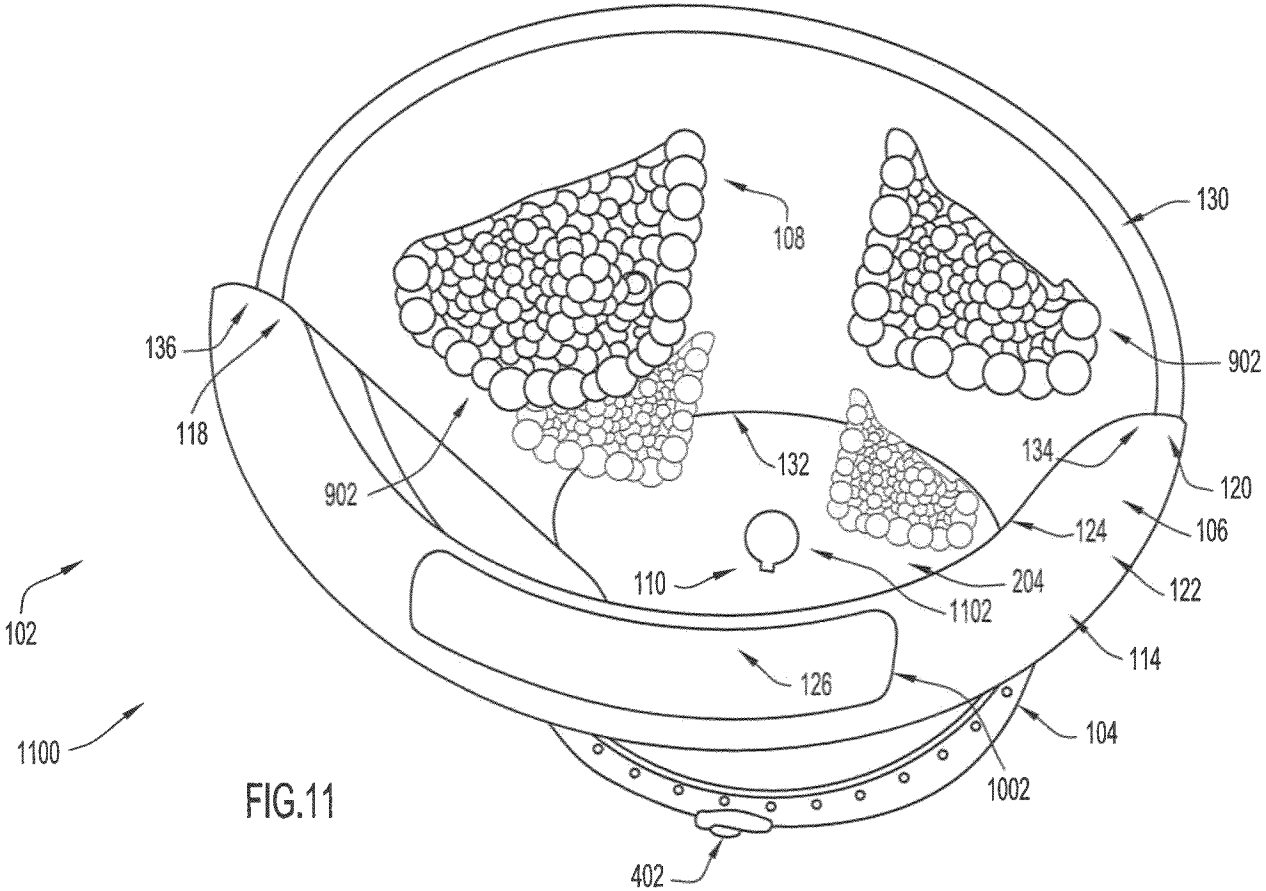
FIG. 11 is a top photographic view of the second embodiment of the toy figure display stand in a closed position without a toy figure.

FIG. 11 is a top photographic view 1100 of the second embodiment of the toy figure display stand 102 in a closed position without a toy FIG. 202. The base 104 includes an upper surface 110. A toy FIG. 202 may be posed on top of the upper surface 110 and within the display chamber 204. The display chamber 204 further includes a connection area 1102 for a doll stand. The doll stand may be attached to the upper surface 110 of the base 104 at the connection area 1102.

Figure 12:
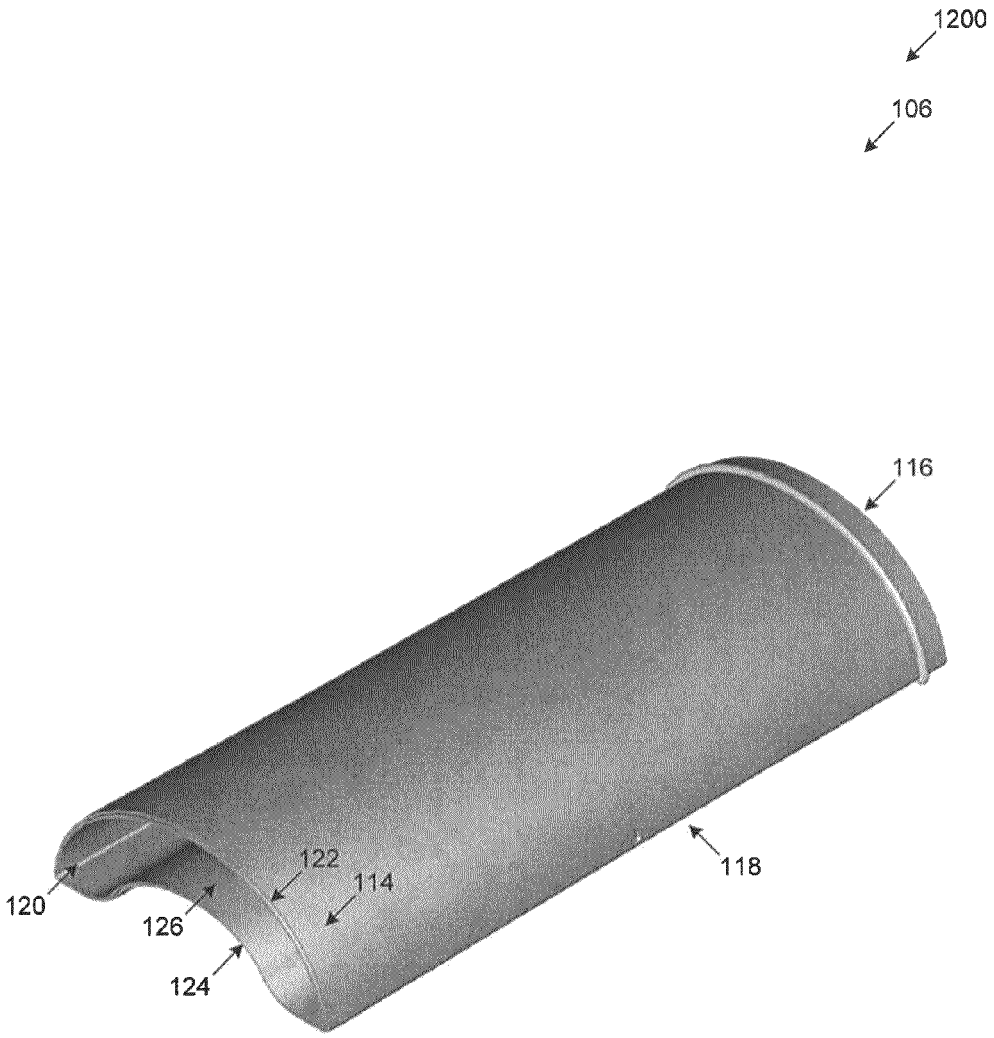
FIG. 12 is a computer drawing from a top left perspective view of a first embodiment of a transparent wall panel.

FIG. 12 is a computer drawing from a top left perspective view 1200 of a first embodiment of a transparent wall panel 106 according to the present invention. The transparent wall panel 106 includes an upper edge 114, a lower edge 116, a left edge 118, and a right edge 120. The transparent wall panel 106 further includes an exterior shell portion 122 and an interior shell portion 124. The exterior shell portion 122 and the interior shell portion 124 form a cavity 126 between the two portions. In this embodiment, the drawing represents the transparent wall panel 106 made from a single piece of acrylic.

Figure 13:
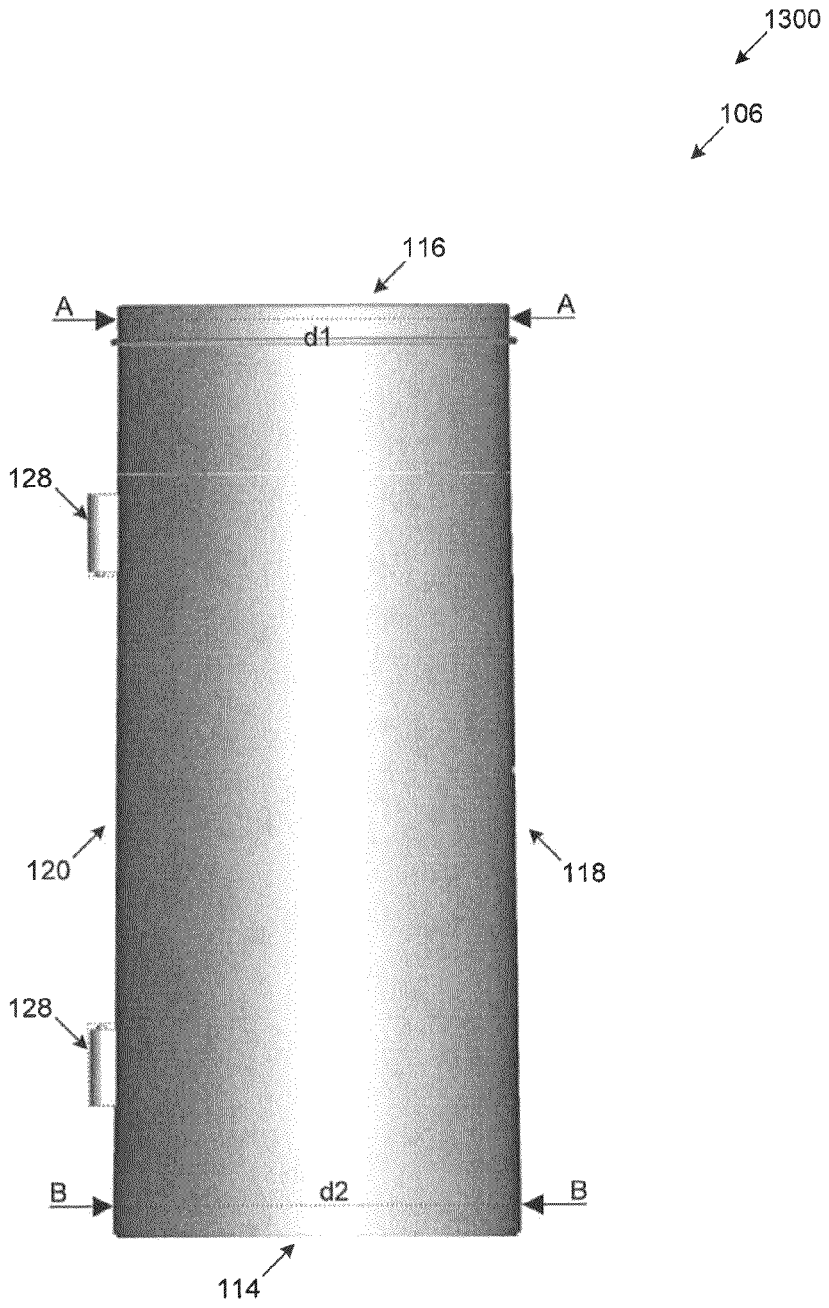
FIG. 13 a computer drawing from an upside-down front view of the first embodiment of a transparent wall panel.

FIG. 13 is a computer drawing from an upside-down front view 1300 of the first embodiment of a transparent wall panel 106. The transparent wall panel 106 includes an upper edge 114, a lower edge 116, a left edge 118, and a right edge 120. The transparent wall panel 106 is tapered such that the front profile of the transparent wall panel is slightly trapezoidal. In this embodiment, the distance d1 from the left edge 118 to the right edge 120 is smaller between the arrows A-A, i.e. close to the lower edge 116, than the distance d2 between the arrows B-B, i.e. close to the upper edge 114. The tapering may aid in providing a draft angle for a more reliable and stable panel creation during an injection molding process.

Figure 14:
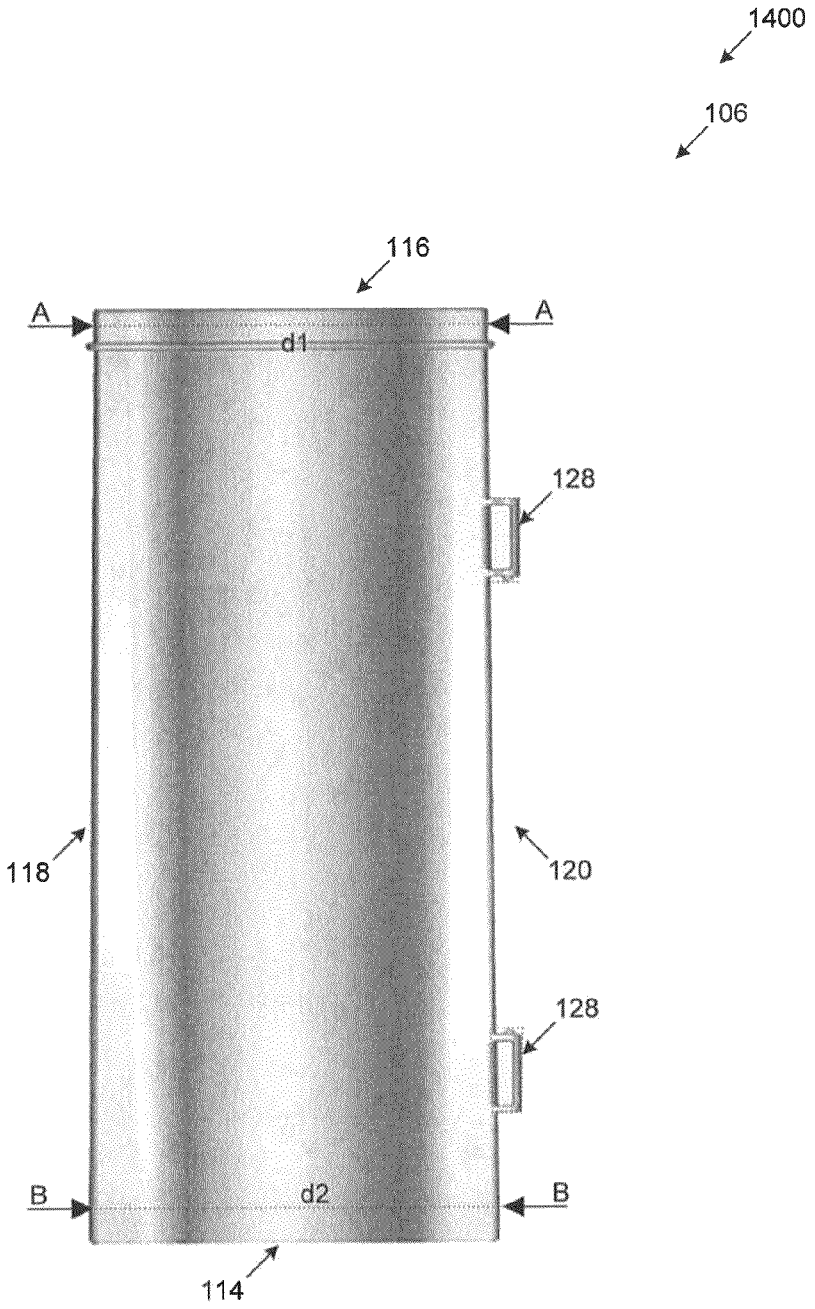
FIG. 14 is a computer drawing from an upside-down back view of the first embodiment of a transparent wall panel.

FIG. 14 is a computer drawing from an upside-down back view 1400 of the first embodiment of a transparent wall panel 106. The transparent wall panel 106 includes two hinges 128 by which a back panel 108 may be attached. In this embodiment, the hinges 128 are located along the right edge 120 of the transparent wall panel 106. The transparent wall panel 106 is tapered such that the back profile of the transparent wall panel is slightly trapezoidal.

Figure 15:
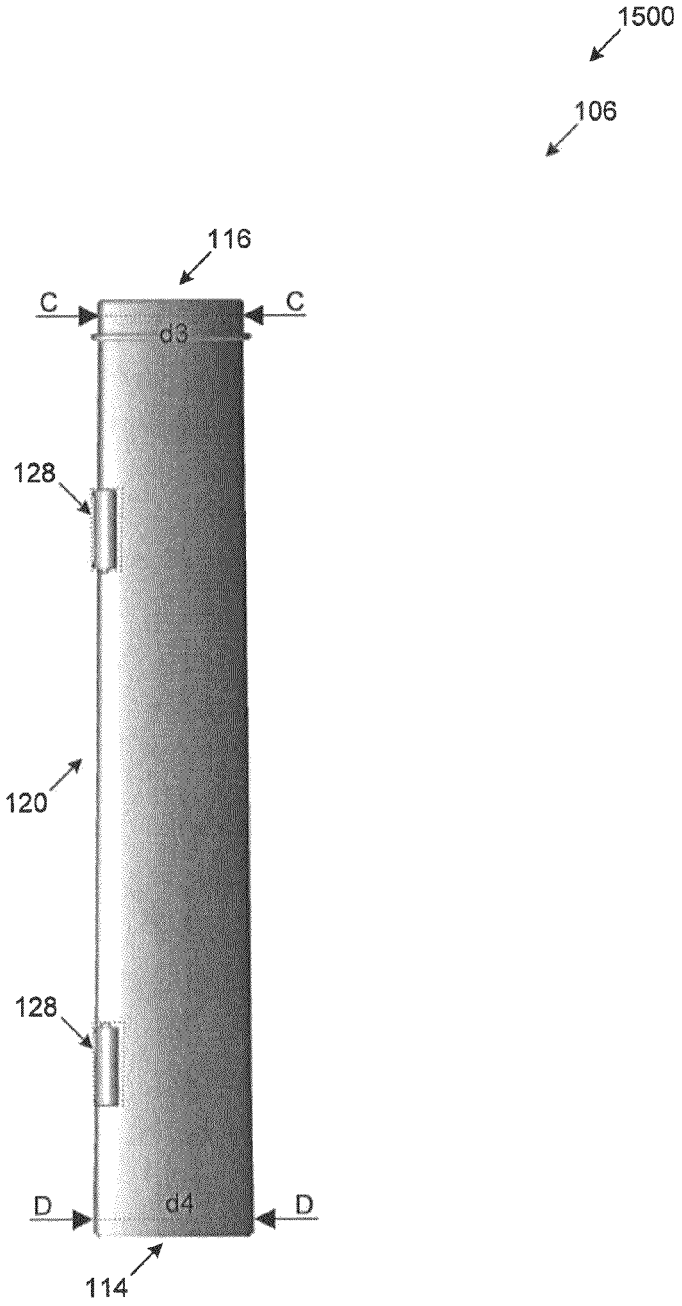
FIG. 15 is a computer drawing from an upside-down right view of the first embodiment of a transparent wall panel.

FIG. 15 is a computer drawing from an upside-down right view 1500 of the first embodiment of a transparent wall panel 106. The transparent wall panel 106 is tapered such that the right profile of the transparent wall panel is slightly trapezoidal. In this embodiment, the distance d3 from the back of the transparent wall panel 106 to the front of the transparent wall panel 106 is smaller between the arrows C-C, i.e. close to the lower edge 116, than the distance d4 between the arrows D-D, i.e. close to the upper edge 114. The tapering may aid in creating a draft angle for a more reliable and stable panel creation during an injection molding process.

Figure 16:
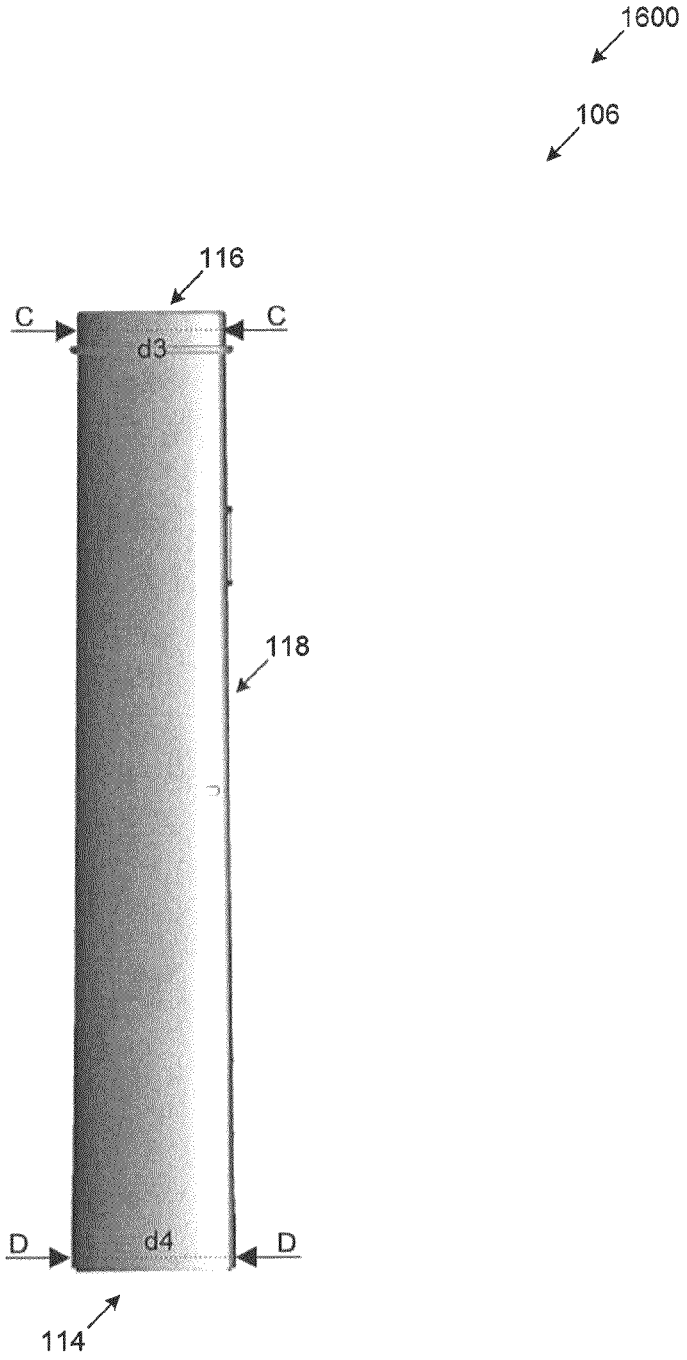
FIG. 16 is a computer drawing from an upside-down left view of the first embodiment of a transparent wall panel.

FIG. 16 is a computer drawing from an upside-down left view 1600 of the first embodiment of a transparent wall panel 106. The transparent wall panel 106 is tapered such that the left profile of the transparent wall panel is slightly trapezoidal.

Figure 17:
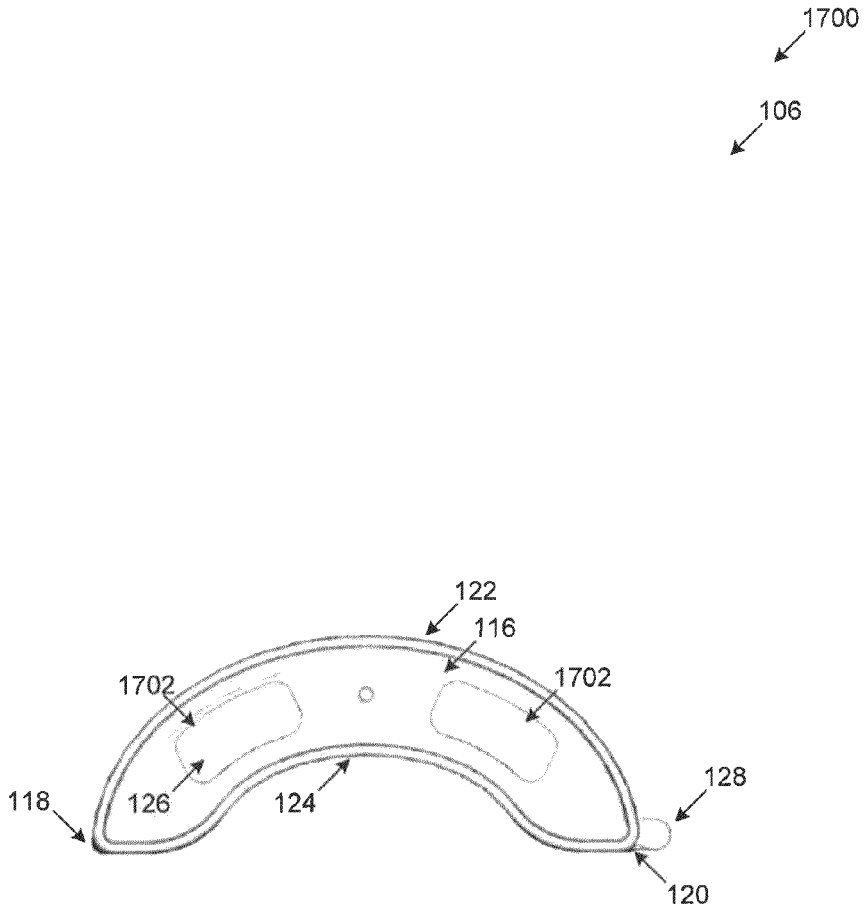
FIG. 17 is a computer drawing from a bottom view of the first embodiment of a transparent wall panel.

FIG. 17 is a computer drawing from a bottom view 1700 of the first embodiment of a transparent wall panel 106. The transparent wall panel 106 includes an upper edge 114 (not visible), a lower edge 116, a left edge 118, and a right edge 120. The transparent wall panel 106 further includes an exterior shell portion 122 and an interior shell portion 124. The exterior shell portion 122 and the interior shell portion 124 form a cavity 126 between the two portions.

In this embodiment, the transparent wall panel 106 includes display enhancement openings 1702 along the lower edge 116 of the transparent wall panel 106. The display enhancement openings 1702 provide access to the interior of the cavity 126 for components that enhance the display of the toy figure. For example, the display enhancement openings 1702 may provide one or more light sources with access to the cavity 126. Alternatively or additionally, the display enhancement openings 1702 may provide an air compressor with access to the interior of the cavity 126 to introduce air bubbles into a fluid in the cavity 126. The display enhancement openings 1702 may be completely or partially filled with a physical or chemical sealant. The sealant may retain a fluid within the cavity 126 and/or prevent leakage of a fluid out of the cavity 126.

Figure 18:
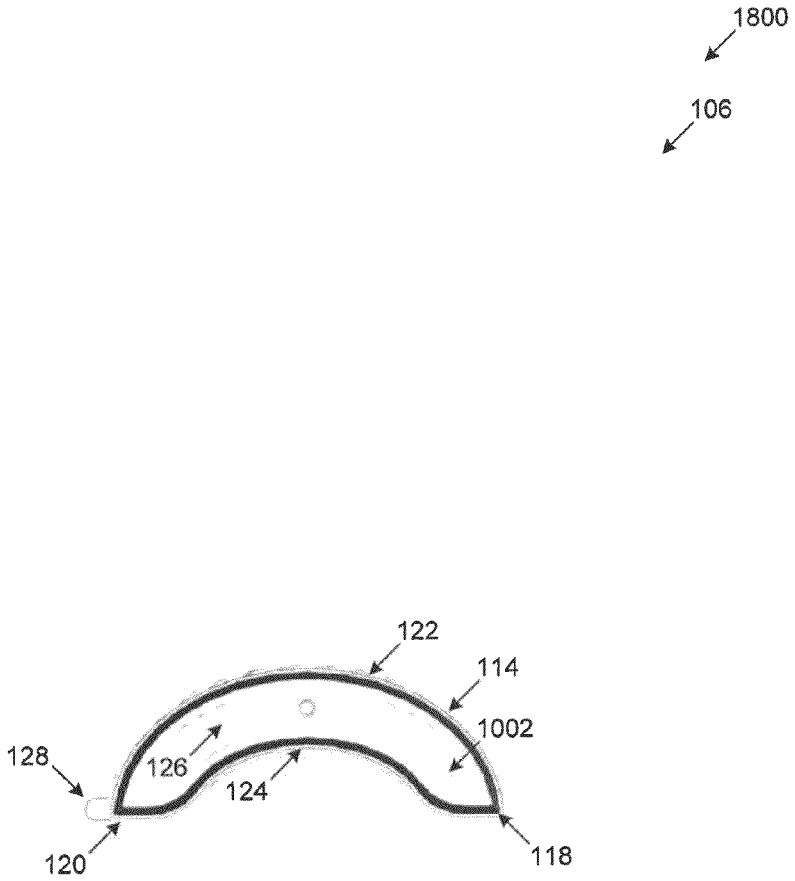
FIG. 18 is a computer drawing from a top view of the first embodiment of a transparent wall panel.

FIG. 18 is a computer drawing from a top view 1800 of the first embodiment of a transparent wall panel 106. The transparent wall panel 106 includes an upper edge 114, a lower edge 116 (not visible), a left edge 118, and a right edge 120. The exterior shell portion 122 and the interior shell portion 124 form a cavity 126 between the two portions. The transparent wall panel 106 includes a fluid exchange opening 1002 along the upper edge 114 of the transparent wall panel 106 that provides access for fluid exchange with the cavity 126.

Figure 19:
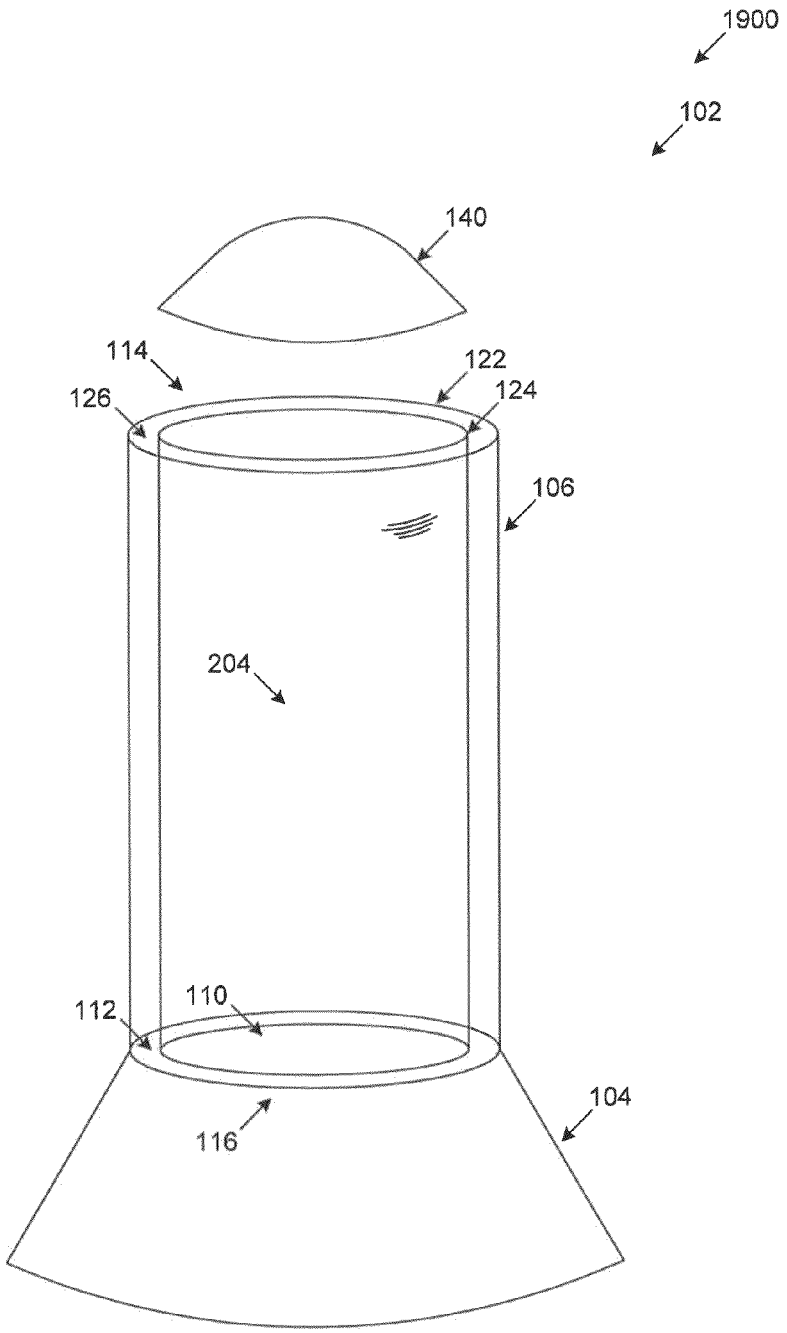
FIG. 19 is a drawing of a fourth embodiment of a toy figure display stand.

FIG. 19 is a drawing 1900 of a fourth embodiment of a toy figure display stand 102 according to the present invention. The toy figure display stand 102 includes a base 104 and a transparent wall panel 106. The base 104 includes an upper surface 110 upon which the transparent wall panel 106 may be mounted or attached. The transparent wall panel 106 may be friction-fitted, compression-fitted, thermally sealed, adhered, or otherwise attached to the upper surface 110 of the base 104 or to a groove 112 or mounting aid in the upper surface 110. A toy figure may be posed to stand on top of the upper surface 110 of the base 104. Such a posed figure may be displayed and viewed from multiple viewing angles through the transparent wall panel 106. In an alternative embodiment, the toy figure may be mounted to the upper surface 110 to better aid in posing the figure and to provide a more consistent display. The base 104 may serve as a pedestal for a toy figure while housing various electronics and components used to enhance the display of the toy figure.

The transparent wall panel 106 includes an upper edge 114 and a lower edge 116. The transparent wall panel 106 may be tapered to provide a draft angle for a more reliable and stable panel creation during an injection molding process. The transparent wall panel 106 further includes an exterior shell portion 122 and an interior shell portion 124. The exterior shell portion 122 and the interior shell portion 124 may be attached to each other along one or more of their edges to form a cavity 126 between the two portions. The two portions may be attached along their edges using physical means, such as one or more screws, chemical means, such as an epoxy, resin, glue, or other adhesive, or thermal means, such as melting the edges together. In a preferred embodiment, the shell portions are formed from a single piece of material. For example, the shell portions may be formed from a single injection-molded piece of plastic or acrylic. In yet another preferred embodiment, the transparent wall panel 106 includes at least one opening along one of its edges that provides access for fluid exchange with the cavity 126 between the two shell portions. The interior shell portion 124 of the transparent wall panel 106 and the upper surface 110 of the base 104 partially enclose a display chamber 204 for a toy figure.

The toy figure display stand 102 further includes an enclosure lid 140. The enclosure lid 140 may be pivotably, hingedly or removably attached to the top of the toy figure display stand 102. In some embodiments, the enclosure lid 140 may be fixedly attached to the upper edge 114 of the transparent wall panel 106. The enclosure lid 140 may keep fluid within the cavity 126 or provide another surface enclosing the toy display chamber 204.

Figure 20:
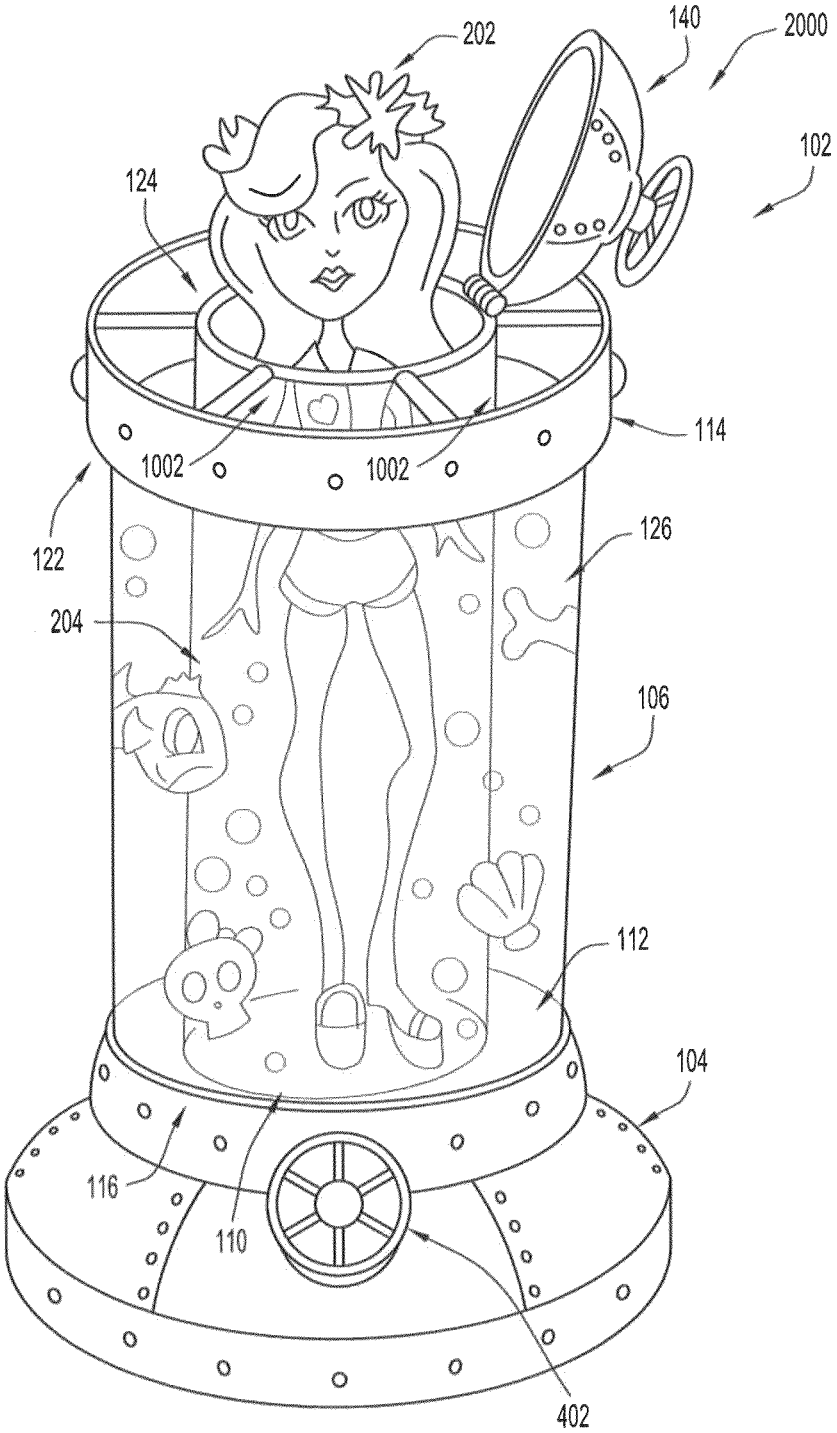
FIG. 20 is a drawing of a fifth embodiment of a toy figure display stand.

FIG. 20 is a drawing 2000 of a fifth embodiment of a toy figure display stand 102 according to the present invention. The toy figure display stand 102 includes a base 104 and a transparent wall panel 106. The base 104 includes an upper surface 110 upon which the transparent wall panel 106 may be mounted or attached. The interior shell portion 124 of the transparent wall panel 106 and the upper surface 110 of the base 104 partially enclose a display chamber 204 for a toy FIG. 202.

The toy FIG. 202 may be posed to stand on top of the upper surface 110 of the base 104. Such a posed figure may be displayed and viewed from multiple viewing angles through the transparent wall panel 106. The base 104 may serve as a pedestal for a toy figure while housing various electronics and components used to enhance the display of the toy figure. The toy figure display stand 102 further includes an actuator 402. The actuator 402 is movably embedded on the base 104. The actuator 402 may be interacted with to activate the various electronics and/or components in the toy figure display stand 102. In this embodiment, the actuator 402 is a dimmer switch in the shape of a ship's steering wheel.

The transparent wall panel 106 includes an upper edge 114 and a lower edge 116. The transparent wall panel 106 further includes an exterior shell portion 122 and an interior shell portion 124. The exterior shell portion 122 and the interior shell portion 124 may be attached to each other along one or more of their edges to form a cavity 126 between the two portions. The transparent wall panel 106 includes a fluid exchange opening 1002 along the upper edge 114 of the transparent wall panel 106 that provides access for fluid exchange with the cavity 126.

An enclosure lid 140 is hingedly connected to the upper edge 114 of the transparent wall panel 106. As illustrated, the enclosure lid 140 is in an open position. In the open position, the enclosure lid 140 does not abut the upper edge 114 of the transparent wall panel 106 except at the hinge joint. The open position may provide physical access to the display chamber 204, for example, to place the toy FIG. 202 inside or take the toy FIG. 202 out of the toy figure display stand 102. Alternatively, the enclosure lid 140 may be in a closed position. In the closed position, the enclosure lid 140 may fully abut the upper edge 114 of the transparent wall panel 106. The enclosure lid 140 may keep fluid within the cavity 126 or provide a surface further enclosing the toy display chamber 204.

Exemplary descriptions of the present invention include the following. In one embodiment, a toy figure display stand comprising a base with an upper surface; and a toy figure display chamber defined within a housing attached to the upper surface of the base, the housing including: a transparent display wall panel including an interior shell portion and an exterior shell portion which together define a cavity; and a back panel attached to the transparent display wall panel, the back panel being movable to provide access to the toy figure display chamber.

In an alternative embodiment, the transparent display wall panel is tapered. In another embodiment, the transparent display wall panel and the back panel form a hollow cylindrical-shaped housing. In another embodiment, transparent display wall panel and the back panel form a hollow elliptic cylindrical-shaped housing. In another embodiment, the back panel is hingedly attached to the transparent display wall panel at a first side of the back panel and attached to the transparent display wall panel at a second side by a latch.

In an alternative embodiment, the transparent display wall panel is formed from a single piece of material. In another embodiment, the transparent display wall panel further includes at least one opening through which a fluid may be introduced into the cavity. In another embodiment, the transparent display wall panel further includes at least one second opening through which a second fluid may be introduced into the fluid within the cavity.

In an alternative embodiment, the toy figure display stand further comprises one or more light sources illuminating the toy figure display stand. In another embodiment, the toy figure display stand further comprises a doll stand attached to the upper surface of the base and within the toy figure display chamber.

In an alternative embodiment, the toy figure display stand further comprises an enclosure lid attached to the housing and defining an upper surface of the toy figure display chamber and the cavity. In another embodiment, the toy figure display stand further comprises an accessory shelf on the back panel within the toy figure display chamber.

In one embodiment, a toy figure display stand comprises a base with an upper surface; and a toy figure display chamber defined within a housing connected to the upper surface of the base, the housing including a transparent display wall panel including an interior shell portion and an exterior shell portion which together define a cavity, the transparent display wall panel being tapered.

In an alternative embodiment, the transparent display wall panel is formed from a single piece of material.

In an alternative embodiment, the transparent display wall panel further includes at least one opening through which a fluid may be introduced into the cavity.

In an alternative embodiment, the transparent display wall panel further includes at least one second opening through which a second fluid may be introduced into the fluid within the cavity.

In another embodiment, a toy figure display stand comprises a base with an upper surface; a toy figure display chamber defined within a housing connected to the upper surface of the base and an enclosure lid, the housing including a transparent display wall panel including an interior shell portion and an exterior shell portion which together define a cavity.

In an alternative embodiment, the enclosure lid is hingedly attached to the housing. In another embodiment, the enclosure lid is removably attached to the housing.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While various embodiments of the toy figure display stand have been described, it will be apparent to those of ordinary skill in the art that many more embodiments and implementations are possible within the scope of the invention. Thus, it is intended that the present invention covers modifications and variations of this invention provided they come within the scope of the appended claims and their equivalents. For example, the majority of the elements can be formed of molded plastic. However, in alternative embodiments, the elements can be formed of a material other than plastic provided that the material has sufficient strength for the component's intended function.

What is claimed is:

1. A toy figure display stand, comprising:

a base with an upper surface; and a toy figure display chamber defined within a housing attached to the upper surface of the base, the housing including:

a transparent display wall panel including an interior shell portion and an exterior shell portion which together define a cavity;

a back panel attached to the transparent display wall panel, the back panel being movable to provide access to the toy figure display chamber; and a doll stand attached to the upper surface of the base and extending within the toy figure display chamber.

2. The toy figure display stand of claim 1, wherein the transparent display wall panel is tapered.

3. The toy figure display stand of claim 2, wherein the transparent display wall panel and the back panel form a hollow cylindrical-shaped housing.

4. The toy figure display stand of claim 3, wherein the transparent display wall panel and the back panel form a hollow elliptic cylindrical-shaped housing.

5. The toy figure display stand of claim 1, wherein the back panel is hingedly attached to the transparent display wall panel at a first side of the back panel and attached to the transparent display wall panel at a second side by a latch.

6. The toy figure display stand of claim 1, wherein the transparent display wall panel is formed from a single piece of material.

7. The toy figure display stand of claim 6, wherein the transparent display wall panel further includes at least one opening through which a fluid may be introduced into the cavity.

8. The toy figure display stand of claim 7, wherein the transparent display wall panel further includes at least one second opening through which a second fluid may be introduced into the fluid within the cavity.

9. The toy figure display stand of claim 6, further comprising:

one or more light sources illuminating the toy figure display stand.

10. The toy figure display stand of claim 1 further comprising:

an enclosure lid attached to the housing and defining an upper surface of the toy figure display chamber and the cavity.

11. The toy figure display stand of claim 1 further comprising:

an accessory shelf on the back panel within the toy figure display chamber.

12. A toy figure display stand, comprising:

a base with an upper surface;

a toy figure display chamber defined within a housing connected to the upper surface of the base, the housing including a transparent display wall panel including an interior shell portion and an exterior shell portion which together define a cavity, the transparent display wall panel being tapered; and a doll stand attached to the upper surface of the base and extending within the toy figure display chamber.

13. The toy figure display stand of claim 12, wherein the transparent display wall panel is formed from a single piece of material.

14. The toy figure display stand of claim 13, wherein the transparent display wall panel further includes at least one opening through which a fluid may be introduced into the cavity.

15. The toy figure display stand of claim 14, wherein the transparent display wall panel further includes at least one second opening through which a second fluid may be introduced into the fluid within the cavity.

16. The toy figure display stand of claim 12, further comprising:

a visual output generating mechanism, wherein the mechanism is disposed in the base and configured to provide output to at least a portion of the toy figure display chamber.

17. A toy figure display stand, comprising:

a base with an upper surface;

a toy figure display chamber defined within a housing connected to the upper surface of the base and an enclosure lid, the housing including a transparent display wall panel including an interior shell portion and an exterior shell portion which together define a cavity; and a doll stand attached to the upper surface of the base and extending within the toy figure display chamber.

18. The toy figure display stand of claim 17, wherein the enclosure lid is hingedly attached to the housing.

19. The toy figure display stand of claim 17, wherein the enclosure lid is removably attached to the housing.

20. The toy figure display stand of claim 17, further comprising:

an air compressor disposed within the base and configured to introduce an airflow into the cavity.

* * * * *

UNITED STATES PATENT AND TRADEMARK OFFICE

CERTIFICATE OF CORRECTION

PATENT NO. : 8,992,281 B2
APPLICATION NO. : 13/446443
DATED : March 31, 2015
INVENTOR(S) : Lui et al.

It is certified that error appears in the above-identified patent and that said Letters Patent is hereby corrected as shown below:

In the Specification

Column 4, lines 26, 38, 43 (both occurrences) change “FIG.” to --figure--.

Column 5, lines 4, 24, 38, 46, 50 and 65 change “FIG.” to --figure--.

Column 6, lines 2, 6, 7 (both occurrences), 18, 39 (both occurrences), 47, 51, 55, 59 and 66 change “FIG.” to --figure--.

Column 7, lines 12 and 13 change “FIG.” to --figure--.

Column 9, lines 20, 21, 49 and 50 change “FIG.” to --figure--.

Signed and Sealed this
Twenty-first Day of July, 2015

Michelle K. Lee

Michelle K. Lee
*Director of the United States Patent and Trademark Office*